US006293647B2

(12) United States Patent
Saijo

(10) Patent No.: US 6,293,647 B2
(45) **Date of Patent: *Sep. 25, 2001**

(54) LIQUID DISCHARGE APPARATUS

(75) Inventor: Yasutsugu Saijo, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/025,417

(22) Filed: Feb. 18, 1998

(30) Foreign Application Priority Data

Feb. 18, 1997 (JP) ..... 9-033740
Feb. 19, 1997 (JP) ..... 9-035321

(51) Int. Cl.[7] ..... B41J 2/165; B41J 2/01; B41J 2/21

(52) U.S. Cl. ..... 347/24; 347/30; 347/32; 347/33; 347/101; 347/43

(58) Field of Search ..... 347/24, 30, 33, 347/101, 23, 29, 43, 36, 35, 22, 10, 32, 31

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,723,129 | | 2/1988 | Endo et al. | 347/56 |
| 4,740,796 | | 4/1988 | Endo et al. | 347/56 |
| 5,051,761 | | 9/1991 | Fisher et al. | 346/140 R |
| 5,166,708 | * | 11/1992 | Hirano et al. | 347/24 |
| 5,495,271 | * | 2/1996 | Koitabashi et al. | 347/24 |
| 5,587,729 | * | 12/1996 | Lee et al. | 347/32 |
| 5,618,338 | * | 4/1997 | Kurabayashi et al. | 347/101 |

FOREIGN PATENT DOCUMENTS

| | | | |
|---|---|---|---|
| 0 465 260 | 1/1992 | (EP) | B41J/2/165 |
| 0 726 153 | 8/1996 | (EP) | B41J/2/165 |
| 0 726 155 | 8/1996 | (EP) | B41J/2/21 |
| 0 739 743 | 10/1996 | (EP) | B41J/2/21 |
| 0 526 061 | 1/1997 | (EP) | B41J/2/165 |
| 54-56847 | 5/1979 | (JP) | B41M/5/26 |
| 59-123670 | 7/1984 | (JP) | B41J/3/04 |
| 59-138461 | 8/1984 | (JP) | B41J/3/04 |
| 60-71260 | 4/1985 | (JP) | B41J/3/04 |
| 5-202328 | 8/1993 | (JP) | C09D/11/00 |
| 8-193175 | 7/1996 | (JP) | C09D/11/00 |
| 10-226057 | 8/1998 | (JP) | B41J/2/01 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A liquid discharge apparatus includes a carriage on which are exchangeably mounted a recording discharging portion, for which is formed a recording liquid discharging port from which a recording liquid is discharged, and a processing liquid discharging portion, for which is formed a processing liquid discharging port from which a processing liquid is discharged to process the recording liquid, a dedicated recording liquid recovery member for, when the carriage is halted, performing a recovery process on a face in which the recording liquid discharging port is formed, and a processing liquid recovery member dedicated for, when the carriage is halted, performing a recovery process on a face in which the processing liquid discharging port is formed. In this apparatus, the processing liquid recovery member is moved separately from the recording liquid recovery member in a direction that differs from a direction in which the carriage moves, so as to be retractable from the face in which the recording liquid discharging port is formed.

55 Claims, 13 Drawing Sheets

LIQUID DISCHARGE APPARATUS

BACKGROUND OF THE INVENTION

1. Field of the Invention

The present invention relates to a liquid discharge apparatus that discharges a liquid, such as ink, onto a recording medium, to record data using an ink-jet recording method.

2. Related Background Art

Conventionally, for the composition of well known inks used for the ink-jet recording method, generally a soluble high boiler, such as glycol, is added to water as a primary element in order to prevent the drying of the ink and the clogging of nozzles. When an ink of this type is employed for printing on regular paper, the fixing of the ejected ink to the regular paper sometimes is not satisfactory, and an uneven image may occur, which is probably due to the uneven distribution of the loading material and the sizing agent on the surface of a recording sheet. Especially when a color image is to be formed, various colors of ink are ejected and overlap at the same location on the recording sheet before each ink color has been fixed to the paper. Therefore, the ink may smear at the boundary between the different colors, or the ink colors may mix unevenly, so that a satisfactory image can not be obtained.

To resolve the above problem with the ink-jet recording method, there is a well known method whereby, before the ejection of recording ink, the surface of a recording medium is coated with a processing liquid (or a printing enhancement-liquid) in order to improve the image quality.

Disclosed, for example, in Japanese Patent Application Laid-Open No. 5-202328 is a recording method employing an ink compound, which includes at least one chemical dying agent that contains at least one carboxyl, and a polyhydric metal salt solution. According to this method, a polyhydric metal salt solution is applied to a recording medium and then an ink compound is applied thereon to form a preferable image.

Further disclosed in Japanese Patent Application Laid-Open No. 8-193175 are an image forming method for obtaining a satisfactory image, and a printing enhancement-liquid and an ink compound that are used with this method.

For an ink-jet recording apparatus, in order to prevent the clogging of a nozzle and a lack of ink in the nozzle, a so-called suction recovery process is generally performed. In this process, capping means, such as rubber, is brought into contact with a face including a discharging port (hereinafter referred to as a discharge face), which is the nozzle end of a recording head, and pump means that communicates with the capping means aspires ink from the nozzle and establishes a negative pressure in the nozzle in order to accelerate the supply of ink from an ink-tank.

In addition, for the ink-jet recording apparatus, protective capping is also generally performed that caps the entire discharge faces of all the unused recording heads in order to prevent the clogging of nozzles in the recording heads that occurs due to the evaporation of ink, and to protect the surrounding surfaces of the discharge faces when the recording heads are not in use.

In a system that employs the inter-reaction of the processing liquid and the ink compound disclosed in the previous publications, the suction recovery means and the protective capping means must be independently provided for a processing liquid type and for a compound ink type in order to prevent the clogging of a liquid discharge head.

Furthermore, a so-called wiping process is generally performed for the ink-jet recording apparatus in order to remove what ink remains on a discharge face after the suction recovery process for the recording head has been completed, and in order to remove a mist composed of the ink compound that occurs during ink ejection and is affixed to the discharge face. In the wiping process, a wiper (wiping means) made of an elastic material, such as rubber, is brought into contact with the discharge face of the head and is moved relative to the discharge face to wipe the face and to remove the affixed substance.

In the system that employs the inter-reaction of the processing liquid and the ink compound disclosed in the previous publications, independent wiping means must be provided for a processing liquid type and for an ink compound type in order to prevent the clogging of the liquid discharge head.

The present applicant has proposed an epochal method in Japanese Patent Application No. 9-31878, submitted before this application, by which to achieve high image quality when recording on regular paper that does not include a special ink receptive layer for ink-jet recording, and a super high image quality for recording on coated paper that has an ink reception layer. According to this method, a processing liquid discharge head for regular paper, which is provided as standard; a K (black) ink discharge head; and a K, light M (magenta) and C (cyan) ink discharge head are exchanged as needed to acquire an image having a desired high quality.

For the structure where the suction recovery means and the protective capping means are provided independently, at least for the processing liquid system and for the ink compound system that reacts with it, and the structure where different recording heads are exchanged as needed to obtain a high quality image corresponding to the object are to be achieved, the size of the apparatus will be increased, and there is limitation to the saving of the space and reduction of the size. That is, in order to provide a structure where the head for the processing liquid and the head for the ink compound can be set in the same position on a carriage on which the recording heads are mounted and where the suction means and the protective capping means can be independently provided, the suction recovery means and the protective means must be provided for each different recording head type in the direction in which the carriage moves (hereinafter also called the main scanning direction), and the length of the apparatus along the main scanning direction of the carriage will be extended.

Similarly, when the structure where the suction recovery means and the protective capping means are provided independently, at least for the processing liquid system and for the ink compound system that reacts with it, and the structure where different recording heads are exchanged as needed to obtain a high quality image corresponding to the object are to be achieved, the size of the apparatus will be increased, and there is limitation to the saving of the space and reduction of the size. That is, in order to provide a structure where the head for the processing liquid and the head for the ink compound can be set in the same position on a carriage on which the recording heads are mounted and where the wiping means can be provided independently, the wiping means must be provided for each different recording head type in the direction in which the carriage moves (hereinafter also called the main scanning direction), and the length of the apparatus along the main scanning direction of the carriage will be extended.

SUMMARY OF THE INVENTION

It is one object of the present invention to provide a liquid discharge apparatus, wherein a recording liquid discharging portion, formed with a recording liquid discharging port from which a recording liquid is discharged, and a processing liquid discharging portion, formed with a processing liquid discharging port from which a processing liquid is discharged to process the recording liquid, are so mounted at the same location on a carriage as to be exchangeable, whereby a simple mechanism can be employed to prevent a mixture of the recording liquid and the processing liquid from being fixed, and it is possible to save space and to reduce the size of the apparatus.

It is another object of the present invention to provide a liquid discharge apparatus, which comprises:

a movably carriage for exchangeably mounting a recording discharging portion formed a recording liquid discharging port for discharging a recording liquid, and a processing liquid discharging portion formed with a processing liquid discharging port for discharging a processing liquid is discharged to process the recording liquid, a recording liquid recovery member dedicated for, when the carriage is halted, performing a recovery process on a face in which the recording liquid discharging port is formed, and a processing liquid recovery member dedicated for, when the carriage is halted, performing a recovery process on a face in which the processing liquid discharging port is formed;

wherein the processing liquid recovery member is moved separately from the recording liquid recovery member in a direction that differs from a direction in which the carriage moves, so as to be retractable from the face in which the recording liquid discharging port is formed.

It is an additional object of the present invention to provide a liquid discharge apparatus, which employs a plurality of liquid discharge heads for recording on a recording medium, and which comprises:

a plurality of capping means for individually capping discharge faces of the liquid discharge heads; and cap exchange means for selectively exchanging the capping means, at the same capping position defined for the capping means, in consonance with those liquid types that are to be ejected from the liquid discharge heads.

According to one aspect of the present invention, since the capping means can be exchanged at the same capping position by the cap exchange means in consonance with the liquid type, the width of the apparatus can be reduced.

The liquid discharge apparatus may further comprise a carriage on which a plurality of liquid discharge heads are mounted and that can move relative to the recording medium. In this aspect, since the apparatus is not a fixed type, which has a length equivalent to the width of the recording medium, and can provide a recording having a constant width while moving relative to the recording medium, the apparatus can also be made smaller in this case.

At least one of the liquid discharge heads may be exchanged, so that a liquid can be discharged that differs from the one employed before the replacement. When, for example, an adequate head is selected in consonance with the quality of an image to be recorded, a protective or suction cap need not be arranged for each head in the main scanning direction, and thus the apparatus can be constructed more compactly.

The liquid discharge apparatus further comprises means for detecting the type of an exchangeable liquid discharge head, and to exchange a cap, the capping means are operated in consonance with the result of the detection. According to this aspect, the cap can be exchanged easily in consonance with the type of liquid that is to be discharged from the head, even when a user is not aware of it.

In a plurality of liquids, at least two liquids may be included that react chemically or physically with each other. In this aspect, even when a completely independent capping process must be performed for head cartridges containing liquids that interact with each other, because of the provision of the cap exchange means, the apparatus can be constructed compactly.

The exchangeable liquid discharge heads that are located at the same position on the carriage may include a specific liquid discharge head from which is discharged a liquid containing color material, and another liquid discharge head from which is discharged a liquid containing a material that coheres with or insolubilizes the coloring material in the liquid discharged from the specific liquid discharge head. In this aspect, even when an independent capping process must be performed relative to a head cartridge that discharges the liquid containing a material that coheres with or insolubilizes the coloring material in the liquid, the size of the apparatus can be reduced by the provision of the cap exchange means.

The cap exchange means may exchange a cap at the same position and in the direction in which the carriage moves. Since the space occupied by the capping means can be reduced in the direction in which the carriage moves, the length of the apparatus can be reduced especially in the direction of the movement of the carriage.

If the cap exchange operation is performed in a pivotal manner or a rotational manner, the cap exchange can be preformed smoothly and rapidly.

By either a pivotal or rotational operation, the cap exchange means may exchange two types of capping means that are used, depending on the liquid type. According to this aspect, a special detection means is not required for detecting the current capping means that faces the head cartridge, and the cap exchange means need only be moved in either direction in consonance with the type of recording head and the type of recording liquid, so that an appropriate cap can be brought to the head. As a result, the number of parts is reduced and the apparatus can be constructed compactly.

A plurality of capping means corresponding to different liquid types may be integrally formed. As a result, the required space and the manufacturing costs can be reduced.

At least one exchangeable capping means may communicate with suction means for sucking and removing a liquid from the discharging ports of the liquid discharge heads. Since the capping means communicates with the suction means, a smaller space is required for their assembly.

It is a further object of the present invention to provide a liquid discharge apparatus, which employs a plurality of liquid discharge heads for recording on a recording medium, and which comprises:

a plurality of wiping means for individually capping discharge faces of the liquid discharge heads; and wiper exchange means for selectively exchanging the capping means, at the same wiping position defined by the wiping means, in consonance with liquid types that are discharged from the liquid discharge heads.

According to this aspect of the present invention, since the wiping means can be exchanged at the same wiping position by the wiper exchange means in consonance with the liquid type, the width of the apparatus can be reduced.

At least one of the liquid discharge heads may be exchanged, so that a liquid can be discharged that differs from the one employed before the replacement. When, for example, an adequate head is selected in consonance with the quality of an image to be recorded, a wiper need not be arranged for each head in the main scanning direction, and thus the apparatus can be constructed more compactly.

The liquid discharge apparatus further comprises means for detecting the type of an exchangeable liquid discharge head, and to perform wiping, the wiping means are operated in consonance with the result of the detection. According to this aspect, the wiper can be exchanged easily in consonance with the type of liquid that is to be discharged from the head, even when a user is not aware of it.

The liquid discharge apparatus further comprises means for detecting the type of a liquid discharged from the exchangeable liquid discharge head, and to perform wiping, the wiping means are operated in consonance with the result of the detection. In this aspect, even when a completely independent wiping process must be performed for head cartridges containing liquids that interact with each other, because of the provision of the wiper exchange means, the apparatus can be constructed compactly.

The exchangeable liquid discharge heads that are located at the same position on the carriage may include a specific liquid discharge head from which is discharged a liquid containing color material, and another liquid discharge head from which is discharged a liquid containing a material that coheres with or insolubilizes the coloring material in the liquid discharged from the specific liquid discharge head. In this aspect, even when an independent capping process must be performed relative to a head cartridge that discharges the liquid containing a material that coheres with or insolubilizes the coloring material in the liquid, the size of the apparatus can be reduced by the provision of the wiper exchange means.

The wiper exchange means may exchange a cap at the same position and in the direction in which the carriage moves. Since the space occupied by the wiping means can be reduced in the direction in which the carriage moves, the length of the apparatus can be reduced especially in the direction of the movement of the carriage.

The wiper exchange operation may be performed in a pivotal manner or a rotational manner. In this aspect, the wiper exchange can be preformed smoothly and rapidly.

By either a unidirectional pivotal or rotational operation, the wiper exchange means may exchange two types of wiping means that are used, depending on the liquid type. According to this aspect, a special detection means is not required for detecting the current wiping means that faces the head cartridge, and the wiper exchange means need only be moved in either direction in consonance with the type of recording head and the type of recording liquid, so that an appropriate wiper can be brought to the head. As a result, the number of parts is reduced and the apparatus can be constructed compactly.

A plurality of wiping means corresponding to different liquid types may be integrally formed. As a result, the required space and the manufacturing costs can be reduced.

Specific wiping means for wiping a discharge face of a liquid discharge head from which a specific liquid is discharged may be retractable relative to the discharge face. In this aspect, since a specific wiping means is retractable, the structure of the wiping means can be simplified and the preciseness of the wiping of the head discharge face can be maintained.

When the specific wiping means is to be retracted from the discharge face of the liquid discharge head, a portion of the discharge face from which liquid has not been removed may be wiped while the positional relationship between a plurality of liquid discharge heads and a plurality of wiping means is being changed. As a result, when another liquid is employed, a thorough wiping can be performed that leaves no residual liquid.

A support member for supporting the specific wiping means may be rotatably or pivotally attached to a support member for supporting the other wiping means. Therefore, only one system need be employed to drive the wiping means.

Of a plurality of wiping means corresponding to a plurality of liquid discharge heads, some of wiping means and other of wiping means may independently perform a wiping process for the discharge faces of the liquid discharge heads. Since the independently driven wiping means are provided, the wiping that is required for a head can efficiently performed.

DETAILED DESCRIPTION OF THE PREFERRED EMBODIMENTS

The preferred embodiments of the present invention will now be described while referring to the accompanying drawings.

First Embodiment

Figure 1:
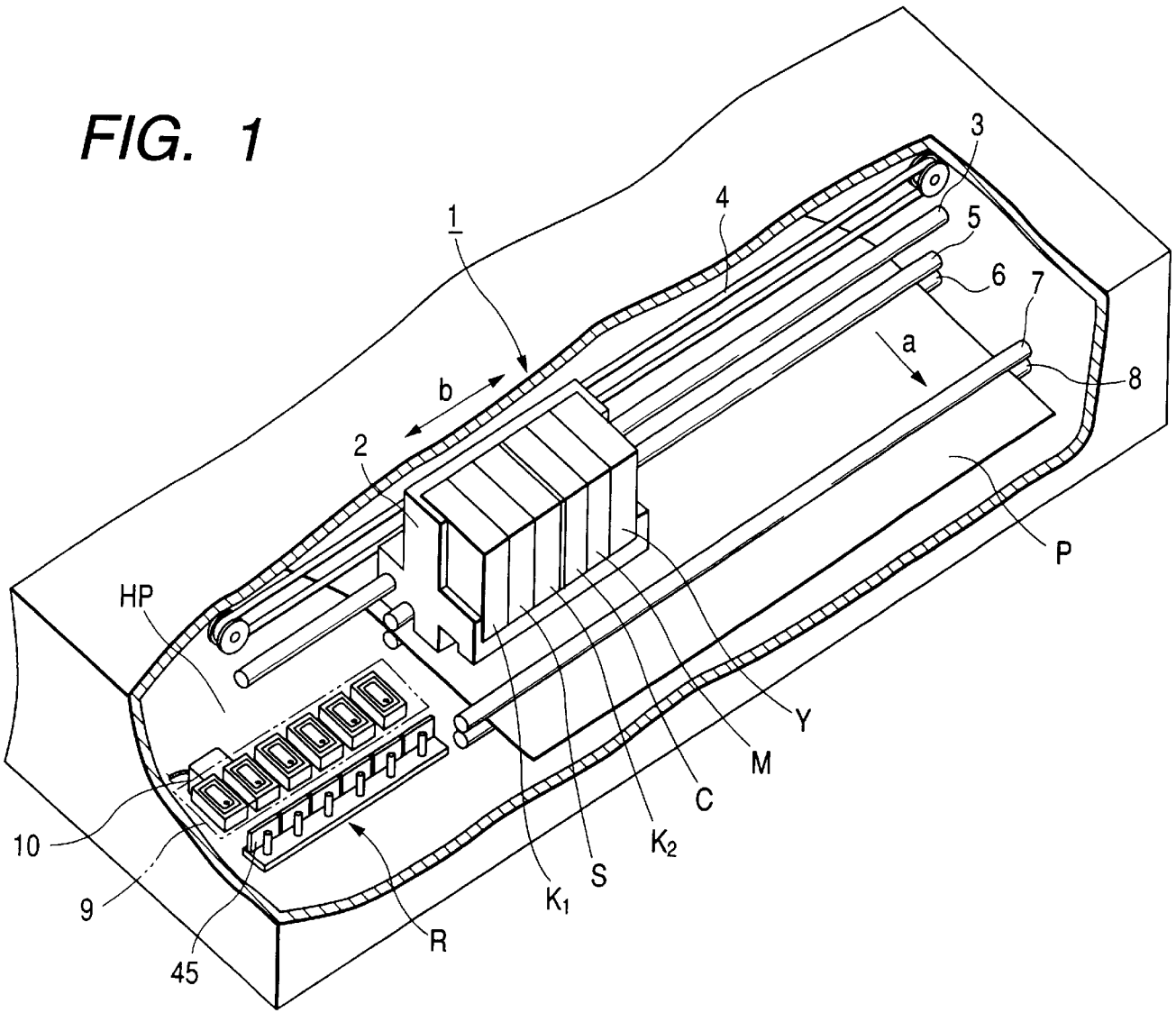
FIG. 1 is a partially exploded, schematic perspective view of an ink-jet recording apparatus employed as a liquid discharge apparatus according to one embodiment of the present invention.
Figure 2:
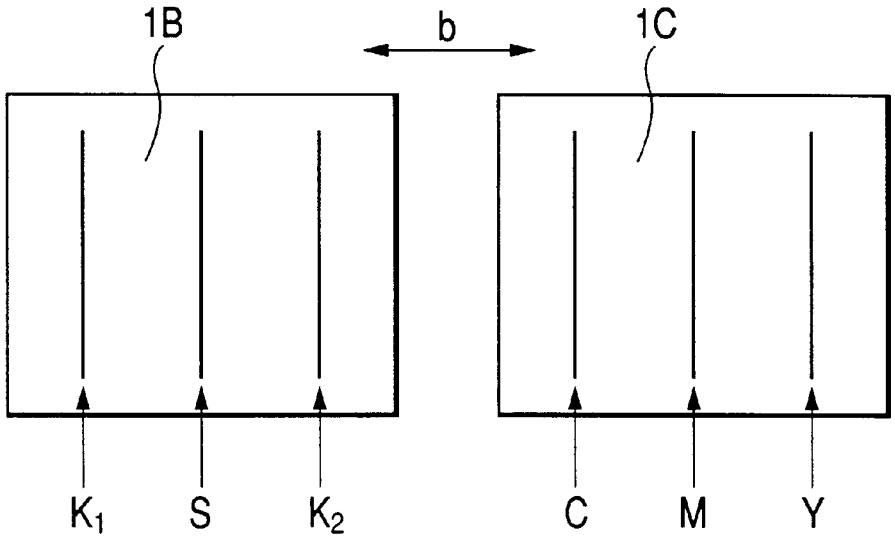
FIG. 2 is a schematic plan view of the arrangement of head cartridges that are detachably connected to the ink-jet recording apparatus in FIG. 1.

FIG. 1 is a partially exploded, schematic perspective view of an ink-jet recording apparatus employed as a liquid discharge apparatus according to a first embodiment of the present invention. FIG. 2 is a schematic plan view of the arrangement of a plurality of head cartridges that can be detachably connected to the ink-jet recording apparatus in FIG. 1.

In FIG. 1, liquid discharge head cartridges (hereinafter referred to as head cartridges) 1, which are mounted on a carriage 2, each comprise a tank, at its upper portion, in which a liquid is retained, and a head, disposed beneath the tank, through which the liquid is discharged onto recording paper P, which serves as a recording medium. When the head cartridges are mounted, connectors for the cartridges 1 are electrically connected to a connector holder-for the carriage 2. Head driving signals, etc., are transmitted via the connectors to the head cartridges 1.

As are shown in FIGS. 1 and 2, the head cartridges 1 in this embodiment are provided as standard for regular paper, and include black ink discharge head cartridges K1 and K2, a cyan ink discharge head cartridge C, a magenta ink discharge head cartridge M, a yellow ink discharge head cartridge Y and a processing liquid discharge head cartridge S to insolubilize dye contained in individual inks. In this embodiment, therefore, a printing enhancement-liquid is discharged through a printing enhancement-liquid discharge head onto the recording paper P, so that it contacts the ink discharged from the head onto the recording paper P and renders the dye water-resistent. In addition, since the dye in the ink reacts with the printing enhancement-liquid on the recording paper and is insolubilized immediately, the outline of an image described with the dye can be sharply defined, and color smearing can be prevented.

Figure 3:
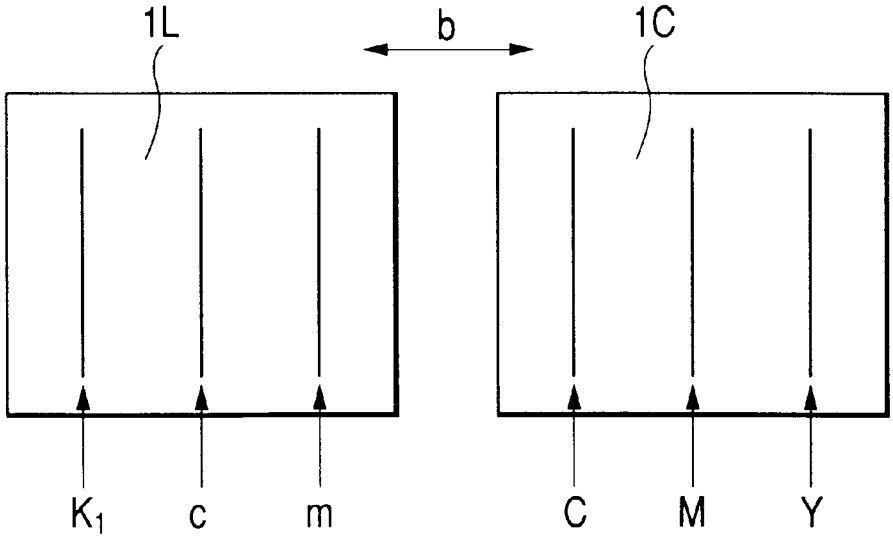
FIG. 3 is a schematic plan view of the arrangement of the head cartridges in FIG. 2 after they have been exchanged.

In this embodiment, as is shown in FIG. 3, the head cartridge S and the black ink discharge head cartridge K2 can be replaced by a light cyan-ink discharge head cartridge c and a light magenta-ink discharge head cartridge m, both of which are optional. As a result, an image having an extremely high quality can be formed by jointly using the light cyan-ink head cartridge c, the cyan-ink discharge head cartridge C and the magenta-ink discharge head cartridge M. That is, since various color tones can be expressed by employing a light color ink and an ink of the same tone containing a higher dye density, an image having an extremely high quality can be easily obtained.

The carriage 2 has a cantilever-like support, and slides along a scan rail 3, which is extended in a direction (indicated by an arrow b and hereinafter referred to as a main scanning direction) perpendicular to a direction (indicated by an arrow a, and hereinafter referred to as a sub-scanning direction) in which the recording paper P is fed. The carriage 2 can be moved reciprocally in the main scanning direction by a driving belt 4.

The recording paper P is sandwiched between and fed by pairs of feed rollers 5 and 6, and 7 and 8, which are provided upstream and downstream in the sub-scanning direction, the recording positions of the heads of the cartridges 1 being used as the references. During the feeding, the recording paper P is pressed against a platen (not shown) that keeps the recording surface flat. In this embodiment, the heads of the cartridges mounted on the carriage 2 are positioned opposite the recording face (top) of the recording paper P, and project downward to the recording face below the carriage 2, separated by a predetermined distance, so that the heads are located in the gap defined by the paired feed rollers 5 and 6, and 7 and 8.

A recovery unit R is located on the chassis of the apparatus at a home position HP on the left side in FIG. 1. The recovery unit R comprises: a capping unit 9, which can contact the discharge faces of the heads of the head cartridges; and a pump unit 10, which communicates with the capping unit 9 and which aspirates the space defined by the discharge face and the capping unit 9 and establishes a negative pressure therein, so that ink discharge failures at the heads are eliminated. In this embodiment, the capping unit 9 has a mechanism that, in consonance with the replacement of the head cartridge, sets a cap so that it corresponds to a new head cartridge, and a cap elevation mechanism that brings the replaced cap into contact with the head of the replacement head cartridge.

When the carriage 2 is at the home position HP, the capping unit 9 contacts the heads of the cartridges 1 and caps them to prevent the ink in the discharging port of the head from becoming more viscous due to evaporation, or to prevent an ink discharge failure due to the insolubilization of ink.

A wiping cleaning member (wiping means) 45 made of an elastic material, such as rubber, is provided for each head cartridge to wipe the discharge faces of the heads of the head cartridges.

In this embodiment, two arrangements are selectively employed: the arrangement in FIG. 2 where mounted in parallel on a carriage are a head cartridge 1B, for which a plurality of discharging port arrays K1, S and K2 are integrally formed, and a head cartridge 1C, for which a plurality of discharging port arrays C, M and Y are integrally formed; and the arrangement in FIG. 3 where mounted in parallel on a carriage are an optional head cartridge 1L, for which a plurality of discharging port arrays K1, c and m area integrally formed, and the above described head cartridge 1C. As is shown in FIG. 1, special caps are positioned for the individual discharging port arrays. When a common cap is employed to perform capping and suction for the processing liquid discharging port array S in the center of the head cartridge 1B and the light-cyan discharging port array c in the center of the optional head cartridge 1L, the two liquids are mixed in the cap or in the suction system, and this causes a problem. To resolve this, a simple and small mechanism, which will be described later, is employed in this embodiment.

Figure 4:
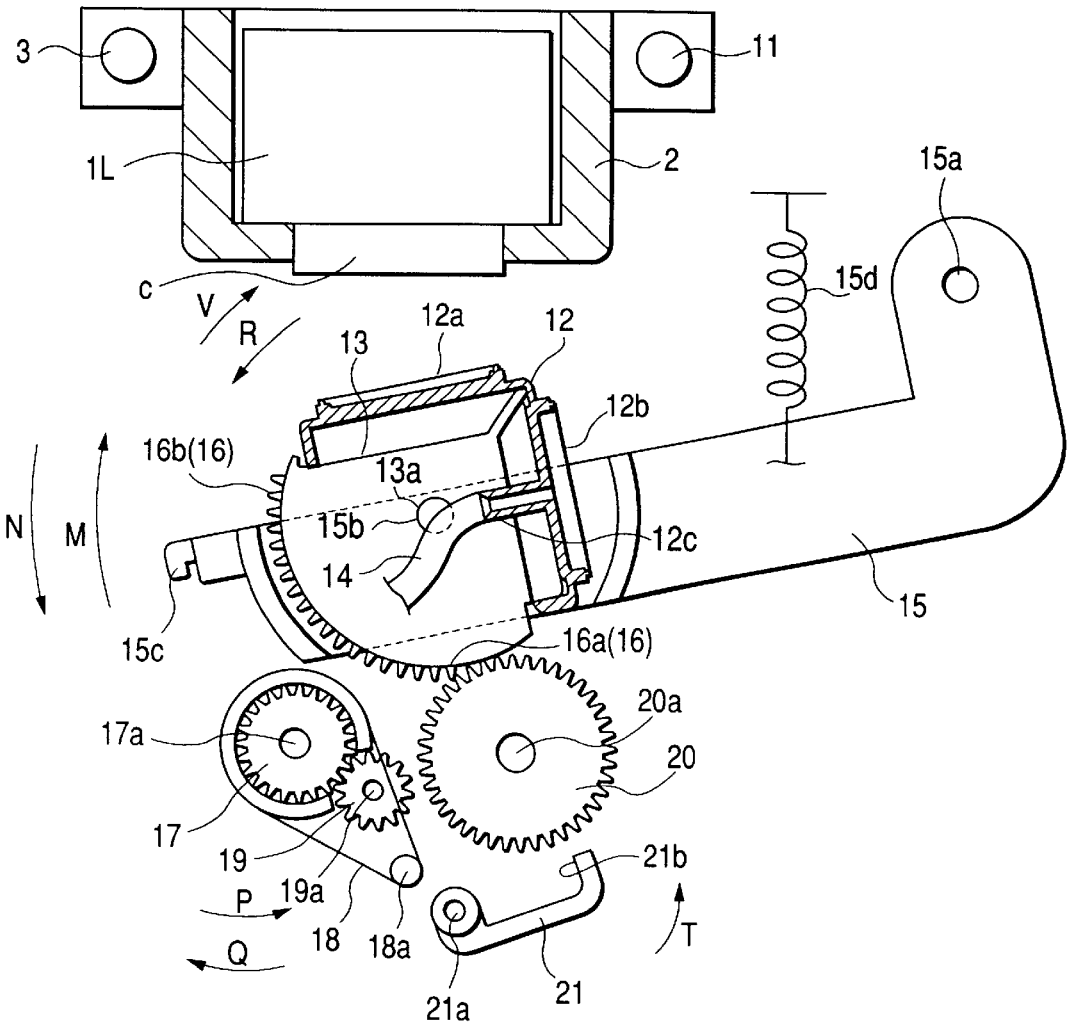
FIG. 4 is a partially exploded, cross-sectional view of a capping unit in the ink-jet recording apparatus according to the embodiment of the present invention.

FIG. 4 is a partially exploded, schematic cross-sectional view of the structure of a capping unit in the same type of recording apparatus as that in FIG. 1. While in FIG. 1 a carriage is shown that is supported, cantilever-like, by the scan rail, in FIG. 4 is shown a recording apparatus having a carriage that is supported by a pair of scan rails running parallel to each other.

In FIG. 4, a scan rail 11 is extended in parallel to a scan rail 3. A carriage 2 is slidably supported by the scan rails 3 and 11. In the example in FIG. 4 is shown the discharging portion of the light cyan discharging port array c of the optional head cartridge 1L that is mounted on the carriage 2.

An integral cap 12 includes a protective cap 12*a* and a suction cap 12*b*, and is fixed to a holder 13. A suction pump (not shown) is connected via a tube 14 to a pipe 12*c* of the suction cap 12*b*.

At the rear edge of an arm 15, its shaft 15*a* is fitted to the housing of the apparatus so as to be rotatable in the direction indicated by an arrow M or arrow N. A center shaft 13*a* of the holder 13 is fitted into a bearing 15*b* in the vicinity of the distal end of the arm 15, and is rotatable in the direction indicated by an arrow V or R. The holder 13 has two planes, the normal lines of which form an angle of about 90 degrees with the center shaft 13*a*, which is used as a reference. The protective cap 12*a* is provided on one of the planes, and the suction cap 12*b* is provided on the other plane. In FIG. 4, since the optional head cartridge 1L is mounted in the carriage 2, the protective cap 12*a* faces toward the discharge face of the head of the head cartridge 1L. As the arm 15 is rotated in the direction indicated by the arrow M, the protective cap 12*a* can abut on the discharge face. The holder 13 also has a gear 16 with the center shaft 13*a* as its reference. The gear 16 has right edge teeth 16*a* and left edge teeth 16*b*.

A pawl 15*c* is formed at the distal end of the arm 15 to maintain the contact state of the cap 12 and the head of the head cartridge.

A through gear 17 is so supported at the housing of the apparatus by its shaft 17*a* as to be rotatable in the direction indicated by an arrow P or Q. A rotatable pendulum arm 18 is provided for the through gear 17, so that it can engage the teeth and provide an appropriate friction. For the pendulum arm 18, a pendulum gear 19 is supported by its shaft 19*a* at a position where it engages the through gear 17.

An idle gear 20 is supported at the housing of the apparatus by a shaft 20*a*. The idle gear 20 can exchange the gear of the holder 13, and can also engage the pendulum gear 19 and can pass it over, while the pendulum arm 18 is rotating in the direction indicated by the arrow P in FIG. 4. A stopper 21 is supported at the housing of the apparatus by a shaft 21*a*. A hook 21*b* at the distal end of the stopper 21 rotates as needed in the direction indicated by an arrow T, and can limit the rotation of a shaft 18*a* at the distal end of the pendulum arm 18.

Since the optional head cartridge 1L is mounted on the carriage 2 in FIG. 4, the protective cap 12*a* faces the head of the head cartridge, and the arm 15 is rotated in the direction indicated by the arrow M by an elastic force exerted by a tension coil spring 15*d*, for example, so that the protective cap 12*a* is brought into contact with the discharge face of the head. As a result, the discharge face can be perfectly protected. In addition, when counter to the above elastic force the arm 15 is rotated in the direction indicated by the arrow N by the pressing force that is exerted by a cam (not shown) that contacts the arm 15, the protective cap 12*a* can be released from the discharge face.

Figure 5:
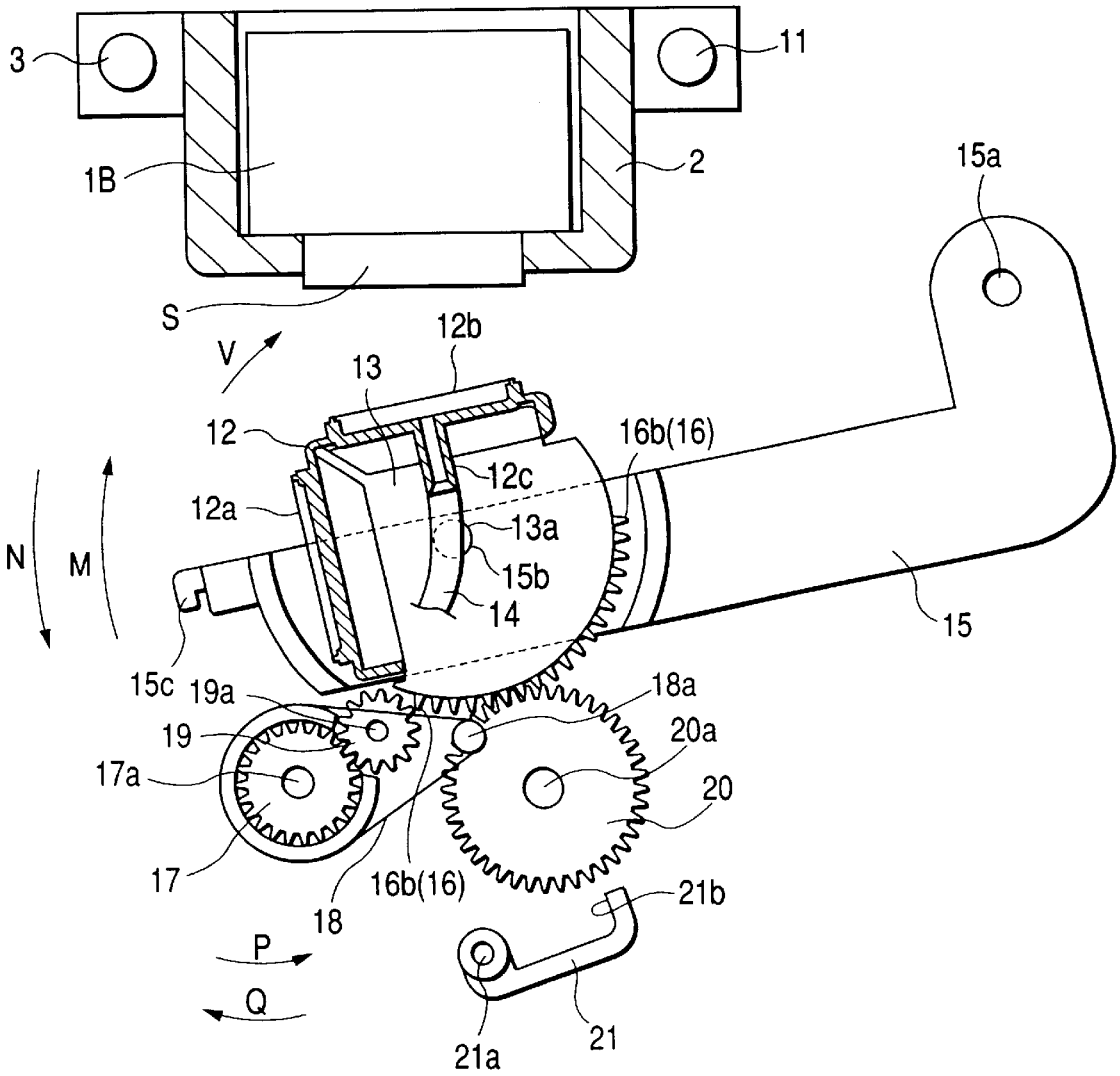
FIG. 5 is a partially exploded, cross-sectional view of a capping unit that handles the capping for head cartridges that are mounted in the same position as those shown in FIG. 4.

FIG. 5 is a partially exploded, schematic cross-sectional view of a capping unit that caps the head cartridge 1B, which is mounted at the same position as that of the optional head cartridge 1L mounted on the carriage 2 in FIG. 4.

When the head cartridge 1L mounted on the carriage 2 in FIG. 4 is replaced by the head cartridge 1B in FIG. 5, the replacement is detected by a detection mechanism (not shown). This detection mechanism can be means for employing a switch, such as a tact switch or a photointerrupter on the carriage 2 or the housing of the apparatus, to detect a projection provided only for the head cartridge 1B. When the through gear 17, in accordance with the results obtained by the detection mechanism, is rotated by a driving source (not shown) in the direction indicated by the arrow P, the pendulum arm 18, which provides an appropriate friction with the through gear 17, is rotated in the same direction P as the through gear 17. As the through gear 17 rotates, the pendulum gear 19 is rotated in the direction indicated by the arrow Q. When the rotation of the through gear 17 is continued, the pendulum gear 19 engages the idle gear 20 for a specific period of time. However, the holder 13 is slightly engaged to the arm 15 by a mechanism (not shown) and therefore fixed, and as the idle gear 20 is also fixed, the pendulum gear 19 passes over the idle gear 20. As the through gear 17 continues to rotate, the right edge teeth 16*a* of the gear of the holder 13 engage the pendulum gear 19. Thus, the holder 13 is released from the slightly engagement state, and gradually rotates in the direction indicated by the arrow R. As the rotation of the pendulum gear 19 is continued, the cap 12 is also rotated with the holder 13 in the direction indicated by an arrow R because there is no gear on the left side of the left edge teeth 16*b* of the gear of the holder 13. With this rotation, the suction cap 12*b* can be positioned so that it faces toward the discharge face of the head of the head cartridge 1B to replace the head cartridge 1L with the head cartridge 1B.

The through gear 17 is rotated in the direction indicated by the arrow Q to release the pendulum gear 19 from the gear of the holder 13, and to return the pendulum gear 18 and the pendulum gear 19 to the positions in FIG. 4. Then, the arm 15 is rotated in the direction indicated by the arrow M to bring the suction cap 12*b* into contact with the discharge face of the head of the head cartridge 1B, so that a discharge recovery operation, such as a suction recovery, can be performed.

An explanation will now be given for the operation of the capping unit when, contrary to the above case, the head cartridge 1B is replaced by the head cartridge 1L.

Figure 6:
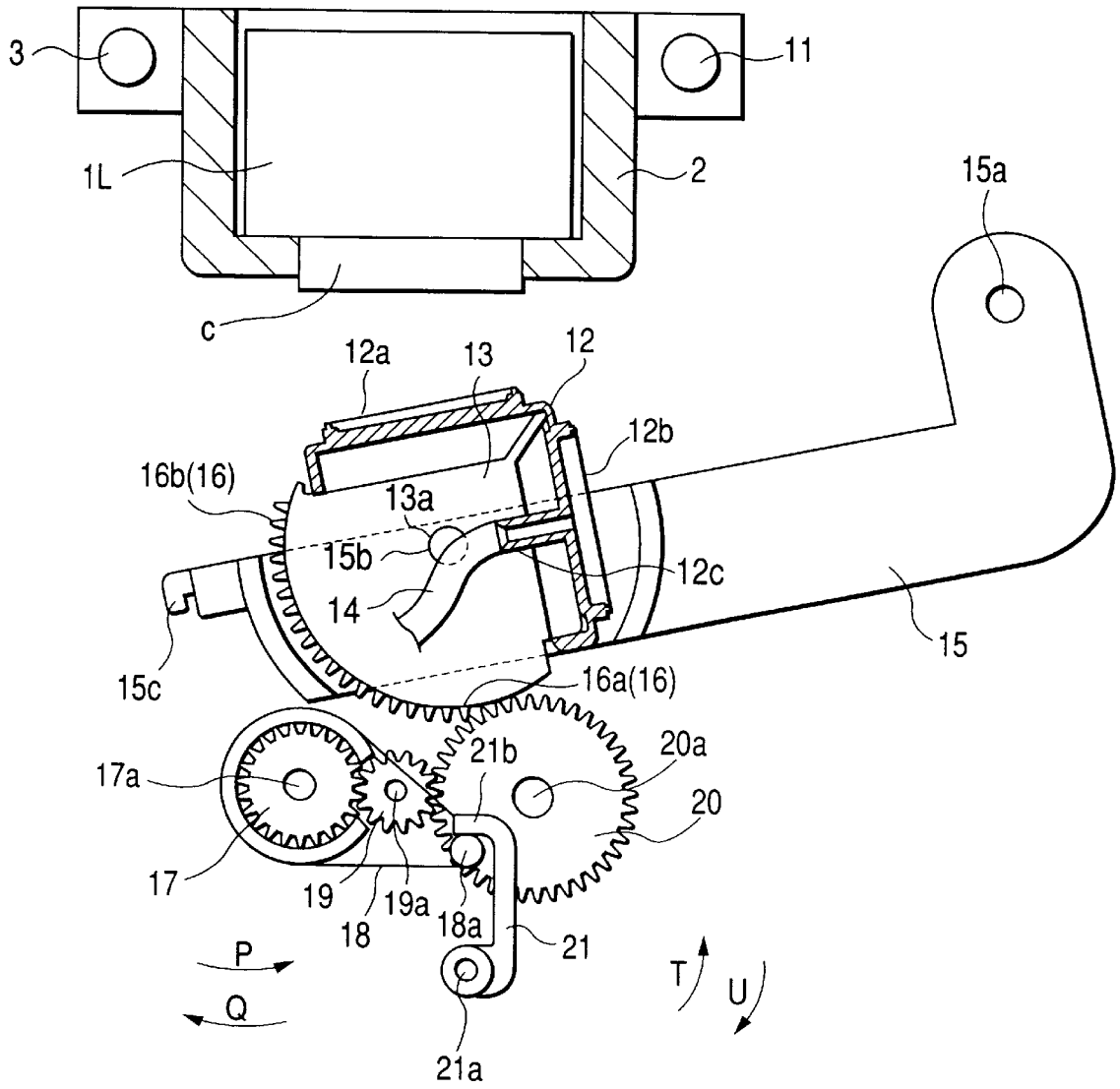
FIG. 6 is a partially exploded, cross-sectional view of a capping unit that handles the capping for head cartridges that are mounted in the same position as those shown in FIG. 5.

FIG. 6 is a partially exploded, schematic cross-sectional view of a capping unit that caps the head cartridge 1L, which is re-mounted at the same position as that of the head cartridge 1B mounted on the carriage 2 in FIG. 5.

In this case, first, the stopper 21 is rotated, by a mechanism (not shown), from the position shown in FIG. 4 in the direction indicated by an arrow T until its hook 21*b* reaches the position in FIG. 6, and it is then maintained at that position. Then, when the through gear 17 is rotated by a mechanism (not shown) in the direction indicated by the arrow P, the pendulum arm 18 is also rotated in the direction indicated by the arrow P. When the rotation is continued, the shaft 18*a* at the distal end contacts the hook 21*b* of the stopper 21 and further rotation is inhibited. At this time, since the pendulum gear 19 engages the through gear 17, even though the friction portion of the pendulum arm 18 passes over the through gear 17, the rotation is continued. The holder 13, in the state shown in FIG. 5, is rotated by the idle gear 20 in the direction indicated by the arrow V in FIG. 5 until it reaches the state shown in FIG. 6. Since there is no gear on the right side of the right edge teeth 16*a* of the holder 13, at that point the rotation of the holder 13 is halted. The integral cap 12 is rotated in consonance with the rotation of the holder 13, and the protective cap 12*a* is directed toward the discharge face of the head of the head cartridge 1L.

In this condition, the through gear 17 is rotated in the direction indicated by an arrow Q in FIG. 6 to return the pendulum arm 18 and the pendulum gear 19 to the positions shown in FIG. 4, and the stopper 21 is rotated in the direction indicated by an arrow U to return it to the position in FIG. 4.

In this embodiment, suction recovery for the light cyan discharging port array c of the head cartridge 1L is performed by driving the suction pump at the same time as the carriage is moved a distance equivalent to the interval between the discharging port arrays, and the light cyan discharge array c is closed with the cap for the black ink discharging port array K1 of the head cartridge 1L.

In the first embodiment, the recording liquid cap and the processing liquid cap are so located that they are opened at an angle to each other of appropriately 90 degrees. So long as both caps are not opened in opposite directions away from each other (180 degrees), the following effects can be obtained.

First, even when a liquid leaks from one cap, it will not be immediately transmitted to the other cap to seal it.

Second, since the caps are not rotated to positions lying in opposite directions, a comparatively simple and small capping mechanism can be constructed.

As is described above, the recording liquid cap and the processing liquid cap should be so located that when open they form a preferable angle of 60° to 120°, a more preferable angle of 80° to 100°, or a most preferable angle of 90°.

Second Embodiment

Figure 7:
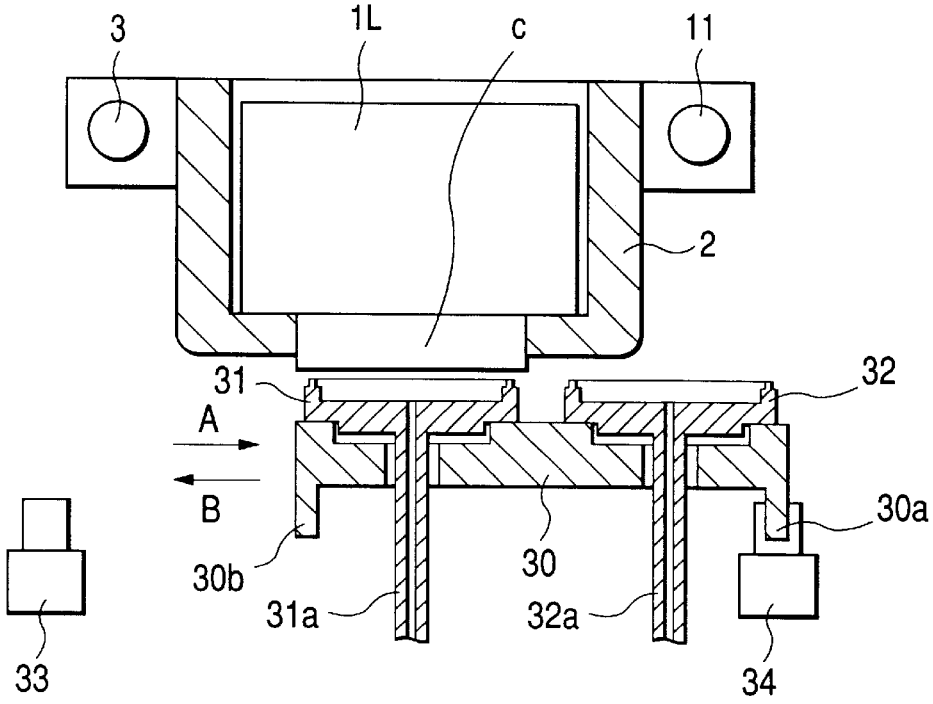
FIG. 7 is a partially exploded, cross-sectional view of a capping unit in an ink-jet recording apparatus according to another embodiment of the present invention.
Figure 8:
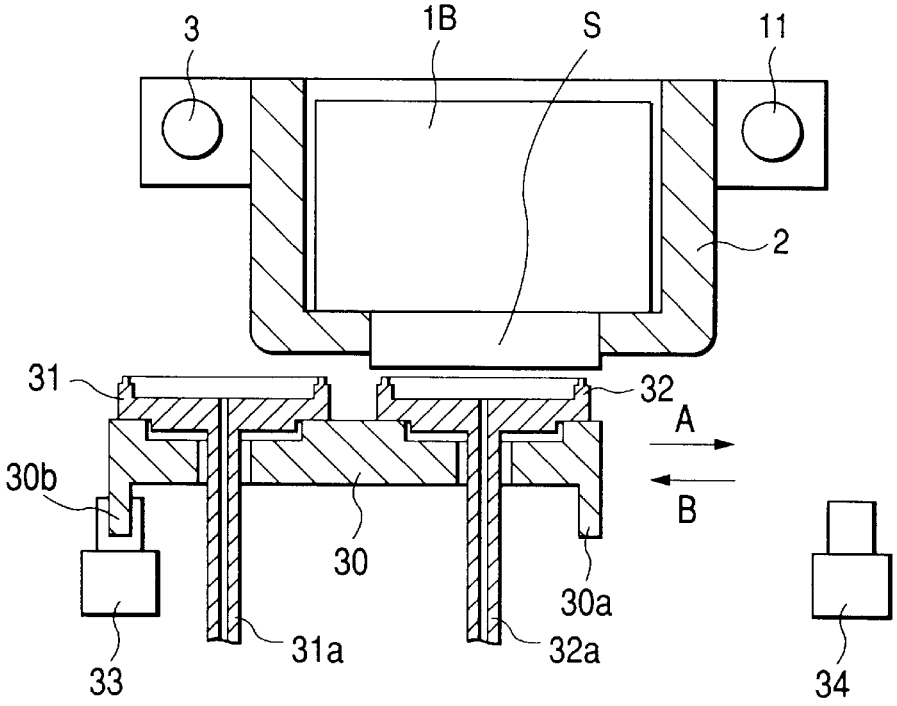
FIG. 8 is a partially exploded, cross-sectional view of a capping unit in an ink-jet recording apparatus according to an additional embodiment of the present invention.

FIGS. 7 and 6 are partially exploded, schematic cross-sectional views of a capping unit for an ink-jet recording apparatus that functions as a liquid discharge apparatus according to a second embodiment of the present invention. In FIG. 7 is shown the structure of a capping unit when a head cartridge 1L is mounted on a cartridge, and in FIG. 8 is shown the structure of a capping unit when a head cartridge 1B is mounted on the carriage. The same reference numerals as are used for the first embodiment a re used to denote corresponding or identical components in this embodiment, and no further explanation for them will be given.

In the first embodiment, a cap is attached to the surface of a rotary member, and selection or exchange of a cap that contacts the head cartridge is accomplished by rotating the rotary member. The feature of this embodiment differs from the first embodiment in that a cap is attached to a slidable member, and selection or exchange of a cap that contacts the head cartridge is accomplished by sliding the member. Another feature is that two types of suction caps are employed as replacement caps, while in the first embodiment a single protective cap and a single suction cap are employed to accomplish the replacement.

A slide holder 30 is slidably supported at the housing of the apparatus. Suction caps 31 and 32 are provided at the top of the slide holder 30. Tubes 31*a* and 32*a*, which are connected to a pump unit 10 in FIG. 1, are attached to the caps 31 and 32. The slide stroke of the slide holder 30 is so determined that it does not exceed a range within which either the cap 31 or 32 will be positioned opposite the head of the head cartridge 1L before and after their displacement. The interval between the caps 31 and 32, and the head of the head cartridge 1L is determined while taking the saving of space into account while ensuring that the head is not wiped when the caps 31 and 32 are displaced. The slide holder 30 can be vertically displaced by an elevation mechanism (not shown), relative to the discharge face of the head of the head cartridge, which is mounted on a carriage 2.

In FIGS. 7 and 8, sensors 33 and 34 are provided at the ends of an area through which the slide holder 30 moves. The sensors 33 and 34 can ascertain the position of the slide holder 30 by detecting the approach, the passage over, and the contact of flag portions 30*a* and 30*b* of the slide holder 30, and can detect the type of cap that is positioned opposite the head of the head cartridge. Electrical or optical detection means, for example, can be used for the sensors 33 and 34.

In the second embodiment, when the head cartridge 1L is mounted on the carriage 2 as is shown in FIG. 7, the slide holder 30 is displaced in the direction indicated by an arrow A until the flag portion 30*a* is detected by the sensor 34. In consonance with this displacement, the suction cap 31 is positioned opposite the discharge face of the head of the head cartridge 1L. The slide holder 30 is displaced vertically, as needed, to an appropriate position by the elevation mechanism (not shown) to perform capping. In this situation, the suction process is initiated to recover at the discharge characteristic of the head of the head cartridge 1L.

When the head cartridge 1B is mounted on the carriage 2 as is shown in FIG. 8, the slide holder 30 is displaced in the direction indicated by an arrow B until the flag portion 30*b* is detected by the sensor 33. In consonance with this displacement, the suction cap 32 is positioned opposite the discharge face of the head of the head cartridge 1B. The slide holder 30 is displaced vertically, as needed, to an appropriate position by the elevation mechanism (not shown) to perform capping. In this situation, the suction process is initiated to recover the discharge characteristic of the head of the head cartridge 1B.

In this embodiment, a cap for contacting the head cartridge can be selectively exchanged by sliding or rotating the slide holder.

Third Embodiment

The structure of wiping means for a third embodiment will now be explained while referring to FIGS. 9 to 14.

Figure 9:
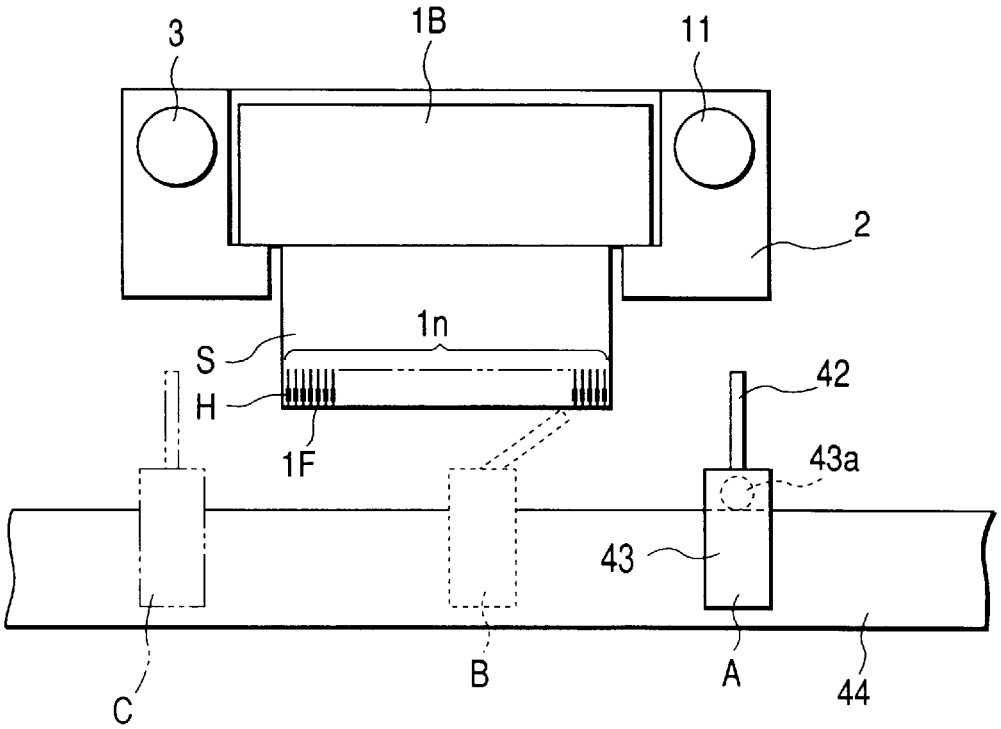
FIG. 9 is a partially exploded, cross-sectional view of the structure of a wiping means in the same type of recording apparatus as that shown in FIG. 1.

FIG. 9 is a partially exploded, schematic cross-sectional view of the structure of wiping means in the same type of recording apparatus as that shown in FIG. 1. While in FIG. 1 is shown a carriage that has a cantilever-like support provided by the scan rail, in FIG. 9 is shown a recording apparatus having a carriage that is supported by a pair of scan rails disposed parallel to each other.

Figure 10:
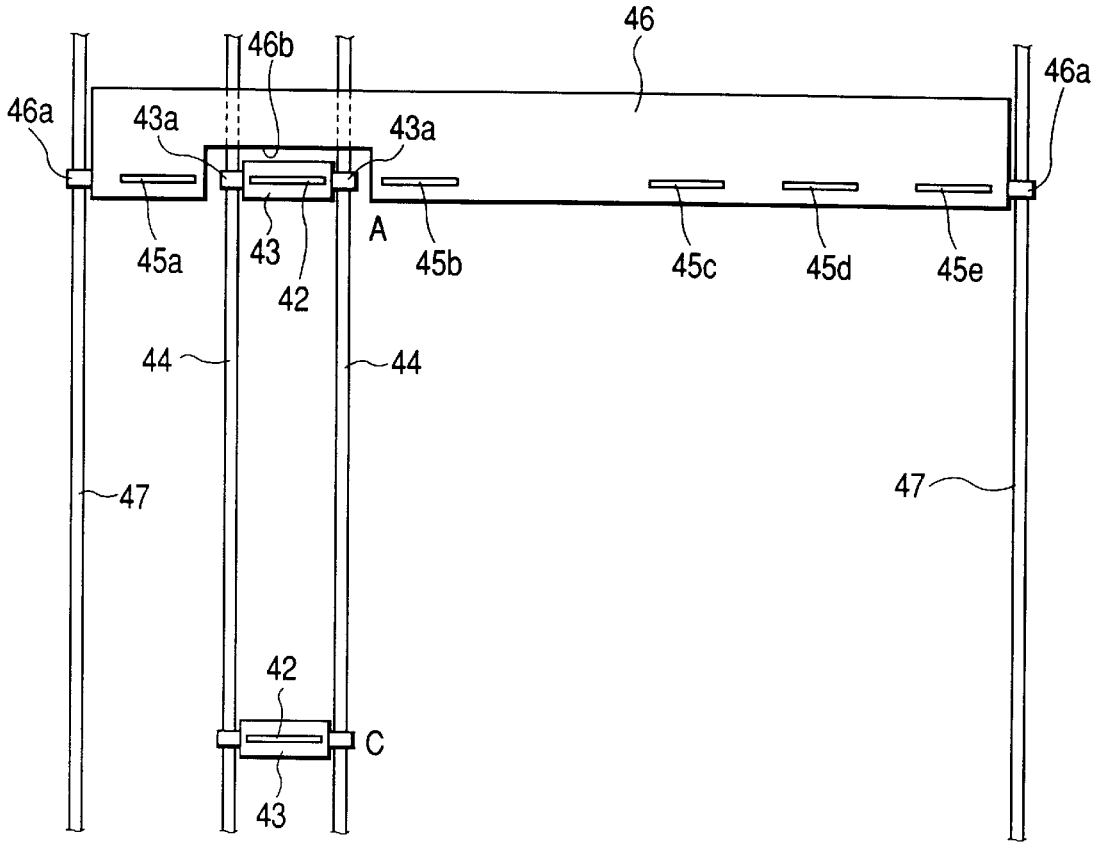
FIG. 10 is a schematic plan view of wiping means and its displacement means according to the embodiment of the present invention.
Figure 11:
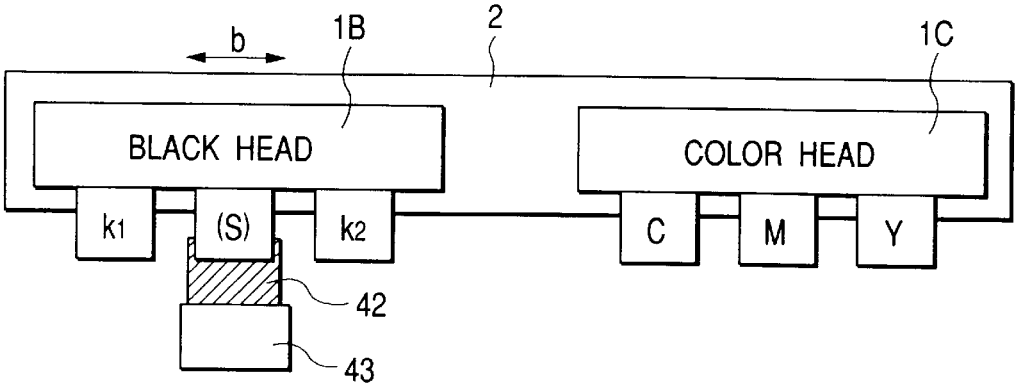
FIG. 11 is a schematic front view depicting a wiping process for the discharge faces of individual heads.
Figure 12:
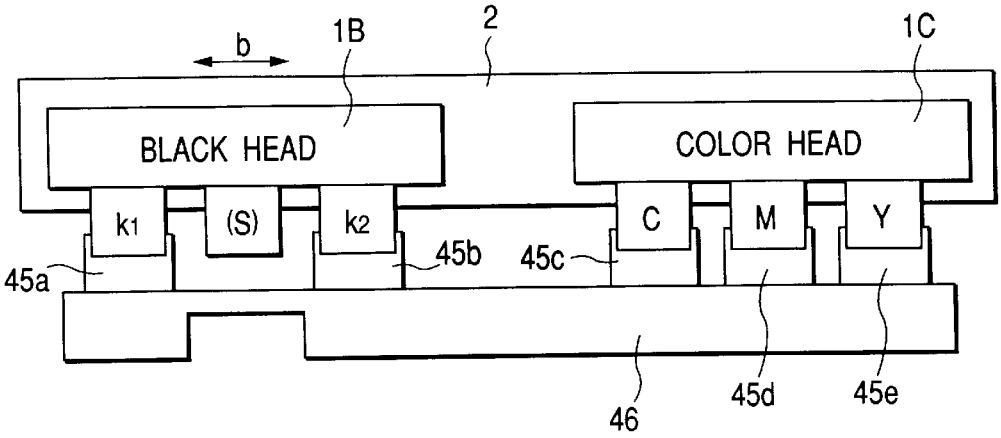
FIG. 12 is a schematic front view depicting the wiping process for the discharge faces of the individual heads.
Figure 13:
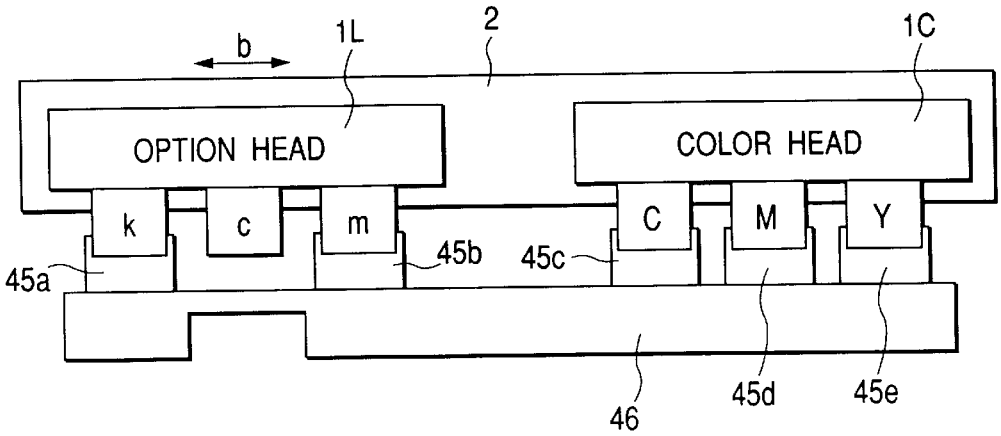
FIG. 13 is a schematic front view depicting the wiping process for the discharge faces of the individual heads.
Figure 14:
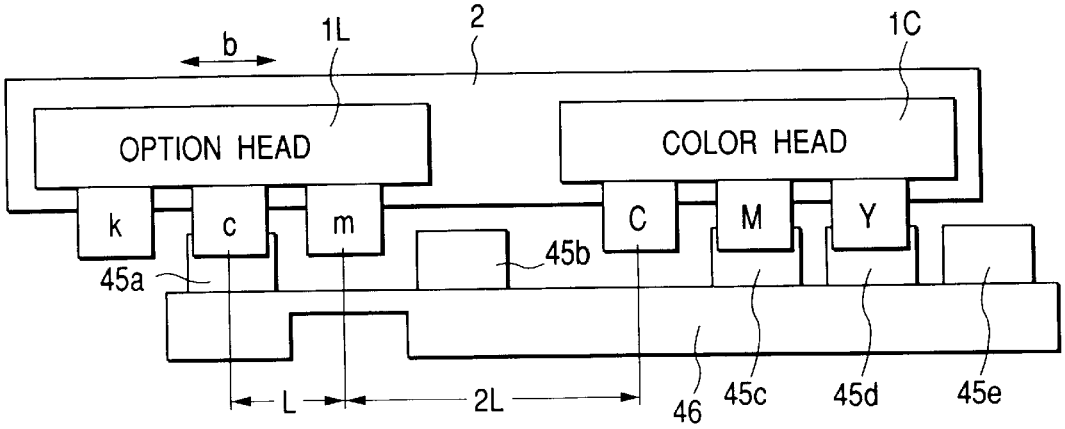
FIG. 14 is a schematic front view depicting the wiping process for the discharge faces of the individual heads.

FIG. 10 is a schematic plan view of the wiping means and its displacement means in this embodiment, and FIGS. 11 to 14 are schematic front views of the states when wiping processes are performed for the discharge faces of individual heads. In FIGS. 11 and 12 is shown the wiping process performed when a standard head cartridge 1B is mounted on a carriage, and in FIGS. 13 and 14 is shown the wiping process performed when an optional head cartridge 1L is mounted on a carriage. The standard head cartridge 1B in FIGS. 11 and 12 is constituted by a head cartridge 1B that includes black-ink discharge head chips K1 and K2 and a printing enhancement-liquid discharge head chip S, and a head cartridge 1C that includes a cyan-ink discharge head chip C, a magenta-ink discharge head chip M and a yellow-ink discharge head chip Y. The optional head cartridge 1L in FIGS. 13 and 14 is constituted by a head cartridge 1L that includes a black-ink discharge head chip K, a light cyan-ink discharge headchip c and a light magenta-ink discharge head chip m, and the above described color head cartridge 1C.

The structure of the wiping means will now be described while referring to FIG. 9.

In FIG. 9, a processing liquid wiper (wiping means) 42 made of elastic material wipes a discharge face 1F of a head from which a printing enhancement-liquid is discharged. An edge 42*a* of the wiper 42, which is shaped like a plate, contacts the discharge face 1F, the base portion of the wiper 42 being supported by a special holder 43. In the upper portion of the holder 43 is a shaft 43*a* that engages a pair of moving rails 44 extending across the housing (not shown) of the apparatus, so that the holder 43 is supported by the rails 44 and can reciprocate along the rails 44 in either direction. An electro-thermal converting element H in FIG. 9 generates thermal energy that is used to discharge liquid from the head discharging port.

As is shown in FIG. 10, ink wipers 45 in this embodiment are black-ink wipers 45*a* and 45*b*, a cyan-ink wiper 45*c*, a magenta-ink wiper 45*d* and a yellow-ink wiper 45*e*. These wipers 45 are supported by a holder 465, which differs from the holder 43 that supports the printing enhancement-liquid wiper 42. In the upper portion of the holder 46 is a shaft 46*a* that engages a pair of moving rails 47 extending across the housing (not shown) of the apparatus, so that the holder 46 is supported by the rails 47 and can reciprocate along the rails 47 in either direction.

The holder 46 is longer than the holder 43, and a notch 46*b* is formed in one part of the holder 46 to permit the holder 43 to pass. The rails 47 are provided to the outside of the rails 44, and rails 44 and 47 are mutually extended in parallel.

An explanation will be given for the wiping process performed for the printing enhancement-liquid discharge head chip S when the head cartridge 1B and the color head cartridge 1C are mounted on the carriage 2.

First, while the holder 43 that supports the printing enhancement-liquid wiper 42 is at standby position A in FIGS. 9 and 10, the carriage 2 is moved in the main scanning direction (indicated by an arrow b) shown in FIG. 12, and is so positioned that the edge 42*a* of the wiper 42 abuts upon the head chip S. Then, the holder 43 is moved in the direction in which the rails 44 extend until it reaches position B, of which point the edge 42*a* of the wiper 42 contacts the discharge face 1F of the head chip S and the wiping is initiated. Since the longitudinal extension of area in, in which the discharging ports that constitute the discharge face 1F are arranged, corresponds to the direction in which the rails 44 extend, the wiping process is performed along the area in until the holder 43 reaches position C.

Following this, an explanation will be given for the wiping process for the head chips that discharge liquids other than the printing enhancement liquid.

First, while the holder 46 for supporting the wipers 45*a* to 45*e* is at standby position A in FIG. 10, the carriage 2 is moved in the main scanning direction (indicated by an arrow b) shown in FIG. 12, and is so positioned that the edges of the wipers 45*a* to 45*e* abut upon the individual head chips. Then, the holder 46 is moved in the direction in which the rails 47 extend until it reaches position B, at which point the edges of the wipers 45*a* to 45*e* contact the discharge faces of the head chips, and the wiping is initiated. The performance of the wiping process continues until the holder 46 reaches position C.

After the wiping process has been completed for the printing enhancement-liquid and various color ink head chips, the carriage 2 is retracted to a position whereat the wipers are not in contact with any head chips, and to prepare for the next wiping process, the holders 44 and 46 are returned to position A in FIGS. 9 and 10 by independent driving sources.

An explanation will be given for the wiping process performed for the individual head chips when the optional head cartridge 1L is mounted on the carriage 2, instead of the standard head cartridge 1B.

First, the holder 43 for supporting the printing enhancement-liquid wiper 42 is moved to position C in FIGS. 9 and 10, and the holder 46 for supporting the ink wipers 45*a* to 45*e* is moved to position A. Then, the carriage 2 is moved and is so positioned that the wipers 45*a* to 45*e* abut upon the head chips k, c, m, C, M and Y. Following this, as the holder 46 is moved to position C in FIG. 10, the wipers 45*a* to 45*e* wipe the discharge faces of the head chips k, c, m, C, M and Y.

The carriage 2 is then retracted to a position whereat the wipers are not in contact with any head chips, and the holders 43 and 46 are respectively returned to position C in FIG. 10 and to position A in FIGS. 9 and 10 by independent driving sources.

Following this, the carriage 2 is moved in the main scanning direction (a direction to the left in FIG. 14, as indicated by an arrow b) and is located at the position shown in FIG. 14. The distance between the individual head chips mounted on the carriage 2 is denoted by L, and the shortest chip interval between the adjacent heads is denoted by 2L. Specifically, in FIG. 14 the distance between the light magenta-ink discharge head chip m and the cyan-ink discharge head chip C is 2L, but may be a multiple of another integer.

Since such a relationship is established, the wipers 45*a*, 45*f* and 45*d* can contact the discharge faces of the head chips C, M and Y.

As is described above, the wiping process can be performed by using different wipers as the carriage 2 is moved in the main scanning direction. That is, after wiping has been performed while the wipers are in contact with the head chips in consonance with the head chip-wiper relationship shown in FIG. 13, the portion of the discharge face of a head chip that has not been wiped can be wiped by another wiper. As a result, the wiping of the discharge face of a head chip can be perfectly performed. In this case, although the remaining portion of the discharge face is wiped by a wiper for a different ink color, since the wiper for the printing enhancement-liquid for insolubilizing the dye contained in the ink is located separately at position C, contamination of the ink and the printing enhancement-liquid on the discharge faces of the head chips does not occur.

Fourth Embodiment

FIGS. 15 to 20 are partially exploded, schematic cross-sectional views of capping means and wiping means, and their associated driving mechanisms for an ink-jet recording apparatus that functions as a liquid discharge apparatus according to a fourth embodiment of the present invention.

Figure 15:
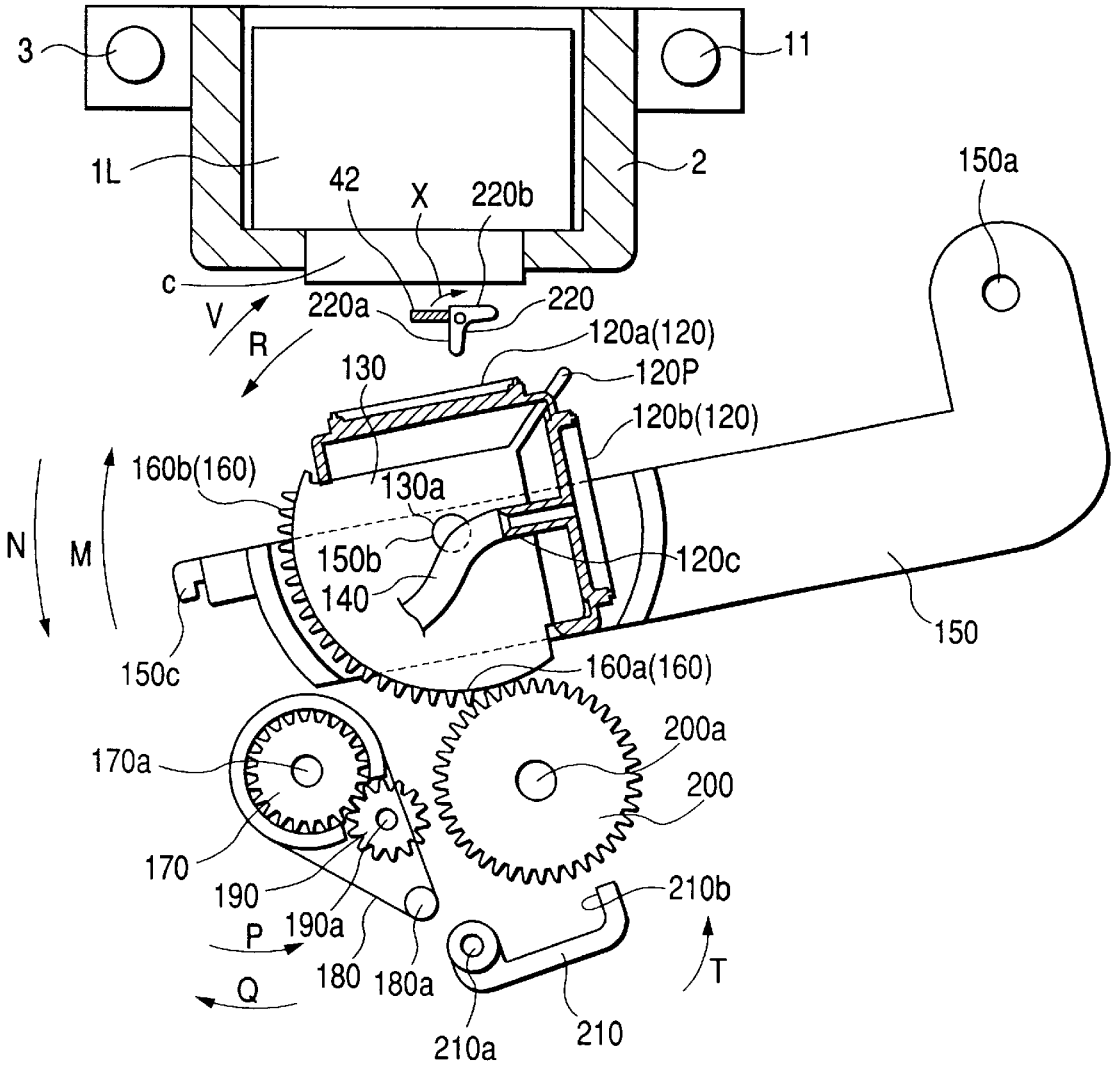
FIG. 15 is a partially exploded, cross-sectional view of the structure of a capping unit in the same type of recording apparatus as that shown in FIG. 1.

FIG. 15 is a partially exploded, schematic cross-sectional view of the structure of a capping unit for the same type of recording apparatus as that in FIG. 1. While in FIG. 1 is shown a carriage that has a cantilever-like support provided by the scan rail, in FIG. 4 is shown a recording apparatus having a carriage that is supported by a pair of scan rails disposed parallel to each other.

In FIG. 15, a scan rail 11 is extended in parallel to a scan rail 3. A carriage 2 is slidably supported by the scan rails 3 and 11. In the example in FIG. 15 is shown the cross section of the previously mentioned optional head cartridge 1L that is mounted on the carriage 2.

An integral cap 120 includes an optional head protective cap 120*a* and a suction cap 120*b* for a head cartridge 1B, and is fixed to a holder 130. A suction pump (not shown) is connected via a tube 140 to a pipe 120*c* of the suction cap 120*b*.

At the rear edge of an arm 150, its shaft 150*a* is fitted to the housing of the apparatus so as to be rotatable in the direction indicated by an arrow M or arrow N. A center shaft 130*a* of the holder 130 is fitted into a bearing 150*b* in the vicinity of the distal end of the arm 150, and is rotatable in the direction indicated by an arrow V or R. The holder 130 has two planes, the normal lines of which form an angle of about 90 degrees with the center shaft 130*a*, which is used as a reference. The protective cap 120*a* is provided on one of the planes, and the suction cap 120*b* is provided on the other plane. In FIG. 15, since the optional head cartridge 1L is mounted in the carriage 2, the protective cap 120*a* faces toward the discharge face of the head of the head cartridge 1L. As the arm 150 is rotated in the direction indicated by the arrow M, the protective cap 120*a* can abut on the discharge face. The holder 130 also has a gear 160 with the center shaft 130*a* as its reference. The gear 160 has right edge teeth 160*a* and left edge teeth 160*b*.

A pawl 150*c* is formed at the distal end of the arm 150 to maintain the contact state of the cap 120 and the head of the head cartridge.

A through gear 170 is so supported at the housing of the apparatus by its shaft 170*a* as to be rotatable in the direction indicated by an arrow P or Q. A rotatable pendulum arm 180 is provided for the through gear 170, so that it can engage the teeth and provide an appropriate friction. For the pendulum arm 180, a pendulum gear 190 is supported by its shaft 190*a* at a position where it engages the through gear 170.

An idle gear 200 is supported at the housing of the apparatus by a shaft 200*a*. The idle gear 200 can exchange the gear of the holder 130, and can also engage the pendulum gear 190 and can pass it over, while the pendulum arm 180 is rotating in the direction indicated by the arrow P in FIG. 15. A stopper 210 is supported at the housing of the apparatus by a shaft 210*a*. A hook 210*b* at the distal end of the stopper 210 rotates as needed in the direction indicated by an arrow T, and can limit the rotation of a shaft 180*a* at the distal end of the pendulum arm 180.

Since the optional head cartridge 1L is mounted on the carriage 2 in FIG. 15, the protective cap 120*a* faces the head of the head cartridge, and the arm 150 is rotated in the direction indicated by the arrow M by a driving source (not shown), as needed, so that the protective cap 120*a* is brought into contact with the discharge face of the head. As a result, the discharge face can be perfectly protected. In addition, when counter to the above elastic force the arm 150 is rotated in the direction indicated by the arrow N by the pressing force that is exerted by a cam (not shown) that contacts the arm 150, the protective cap 120*a* can be released from the discharge face.

Figure 16:
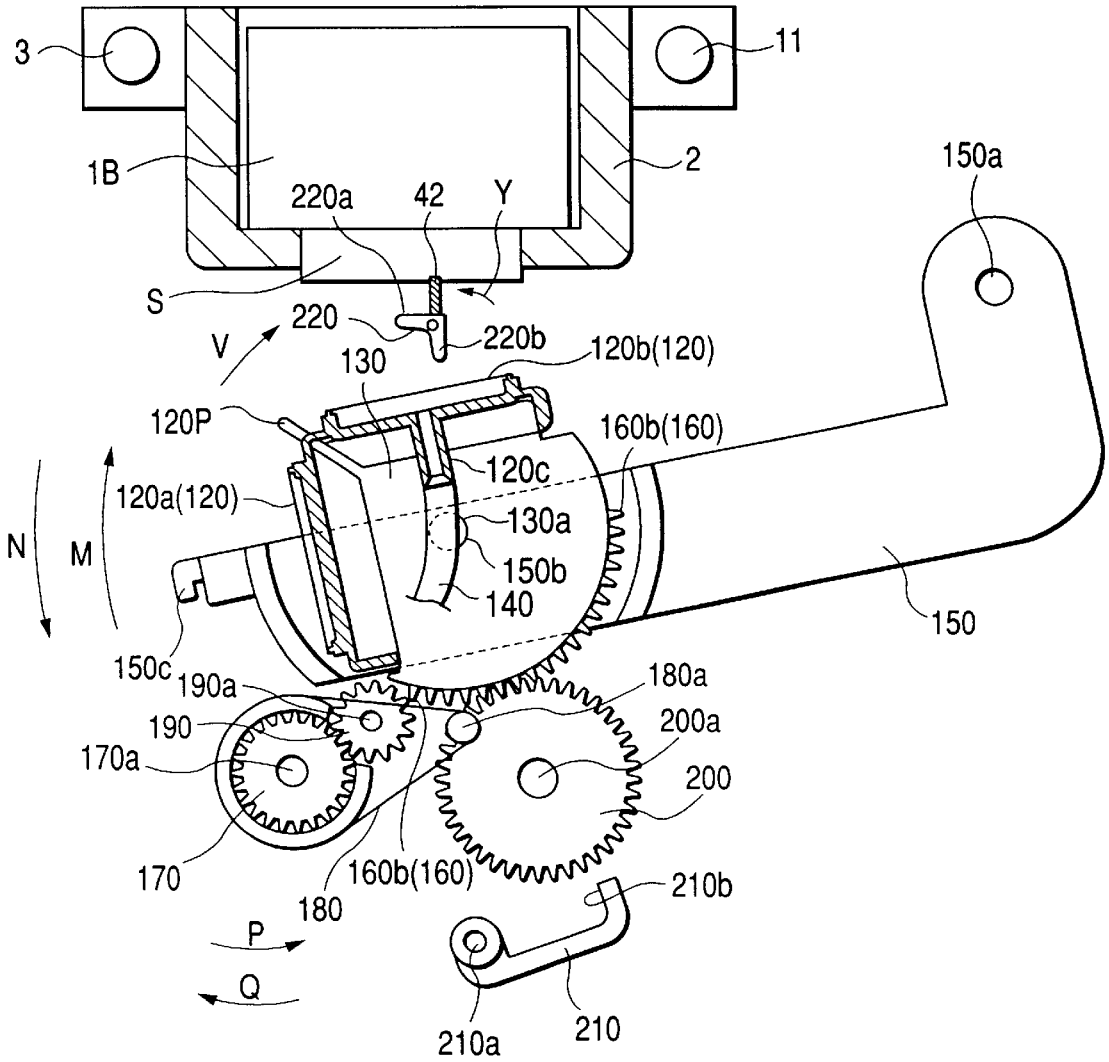
FIG. 16 is a partially exploded, schematic cross-sectional view of the wiping means that handles the wiping of a head cartridge that is mounted in the same location on a carriage as is the light-color ink head cartridge in FIG. 15.

FIG. 16 is a partially exploded, schematic cross-sectional view of a wiping means that wipes the head cartridge 1B, which is mounted at the same position as that of the optional head cartridge 1L mounted on the carriage 2 in FIG. 15.

When the head cartridge 1L mounted on the carriage 2 in FIG. 15 is replaced by the head cartridge 1B in FIG. 16, the replacement is detected by a detection mechanism (not shown). This detection mechanism can be means for employing a switch, such as a tact switch or a photointerrupter on the carriage 2 or the housing of the apparatus, to detect a projection provided only for the head cartridge 1B. When the through gear 170, in accordance with the results obtained by the detection mechanism, is rotated by a driving source (not shown) in the direction indicated by the arrow P, the pendulum arm 180, which provides an appropriate friction with the through gear 170, is rotated in the same direction P as the through gear 170. As the through gear 170 rotates, the pendulum gear 190 is rotated in the direction indicated by the arrow Q. When the rotation of the through gear 170 is continued, the pendulum gear 190 engages the idle gear 200 for a specific period of time. However, the holder 130 is slightly engaged to the arm 150 by a mechanism (not shown) and therefore fixed, and as the idle gear 200 is also fixed, the pendulum gear 190 passes over the idle gear 200. As the through gear 170 continues to rotate, the right edge teeth 160*a* of the gear of the holder 130 engage the pendulum gear 190. Thus, the holder 130 is released from the slightly engagement state, and gradually rotates in the direction indicated by the arrow R in FIG. 16. As the rotation of the pendulum gear 190 is continued, the cap 120 is also rotated with the holder 130 in the direction indicated by an arrow R because there is no gear on the left side of the left edge teeth 160*b* of the gear of the holder 130. With this rotation, the suction cap 120*b* can be positioned so that it faces toward the discharge face of the head of the head cartridge 1L to replace the head cartridge 1B with the head cartridge 1L.

The through gear 170 is rotated in the direction indicated by the arrow Q to release the pendulum gear 190 from the gear of the holder 130, and to return the pendulum gear 180 and the pendulum gear 190 to the positions in FIG. 15. Then, the arm 150 is rotated in the direction indicated by the arrow M to bring the suction cap 120*b* into contact with the discharge face of the head of the head cartridge 1L, so that a discharge recovery operation, such as a suction recovery, can be performed.

During the operation, as the holder 120 is rotated in the direction indicated by an arrow R in FIG. 15, a projection 120*b* of the holder 120 abuts upon a raised portion 220*a* of a holder 220 that supports a printing enhancement-liquid wiper 42. When contact is made, the holder 220 is rotated in the direction indicated by an arrow X. As a result of this rotation, the distal end of the wiper 42 abuts upon the discharge face of the head chip S in the head cartridge 1B. In this case, a so-called toggle mechanism can be built into the holder 220 in order to perform a more precise operation. In addition, since the carriage 2 is retracted to a position whereat it is not in contact with the wiper and the cap, it does not adversely affect the wiping and the capping processing.

An explanation will now be given for the operation of the capping and wiping processes performed when, contrary to the above case, the head cartridge 1B is replaced by the head cartridge 1L.

Figure 17:
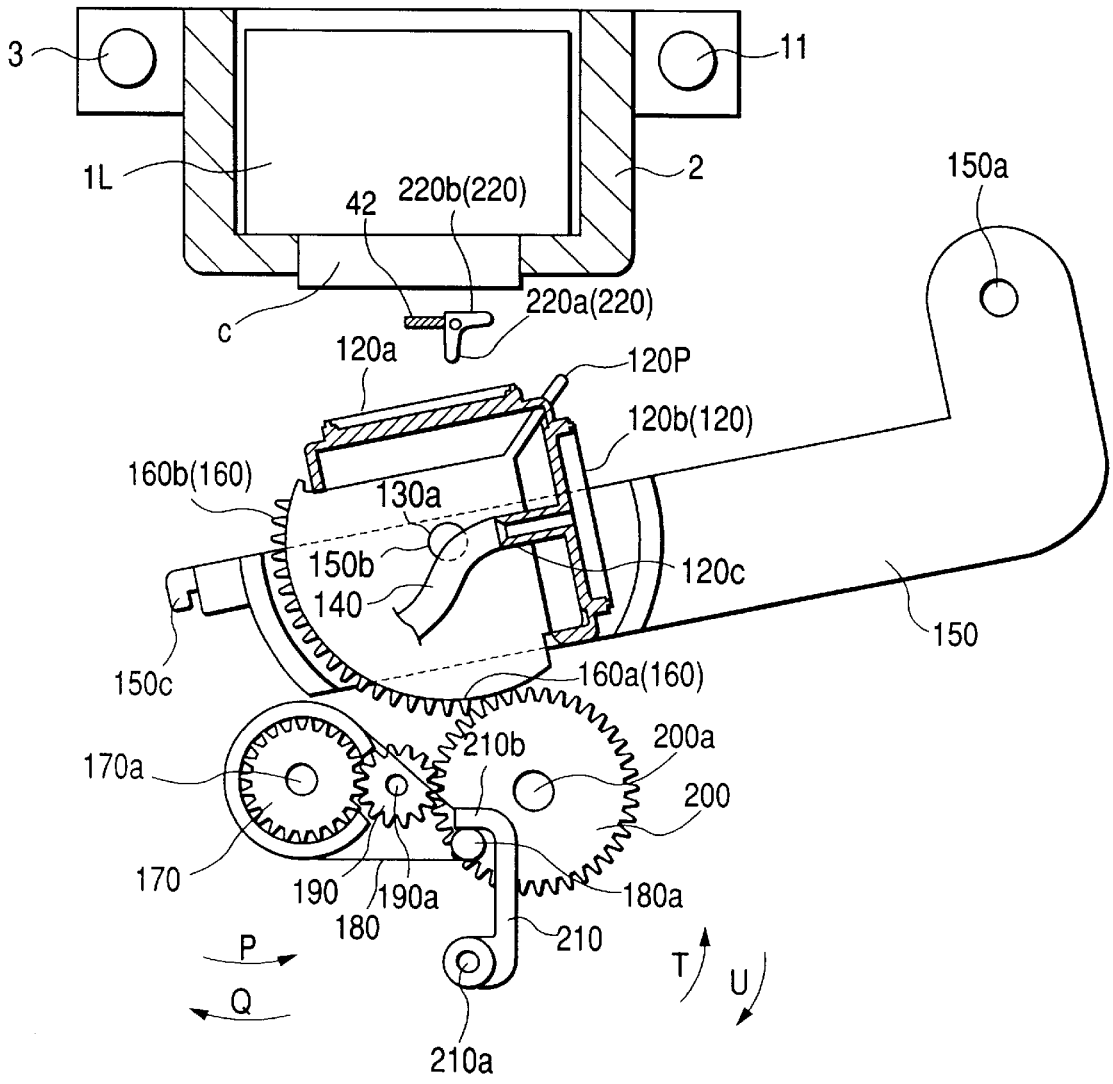
FIG. 17 is a partially exploded, schematic cross-sectional view of the wiping means that handles the wiping for a light-color ink head cartridge that is mounted in the same location on the carriage as is the ink head cartridge in FIG. 16.
Figure 18:
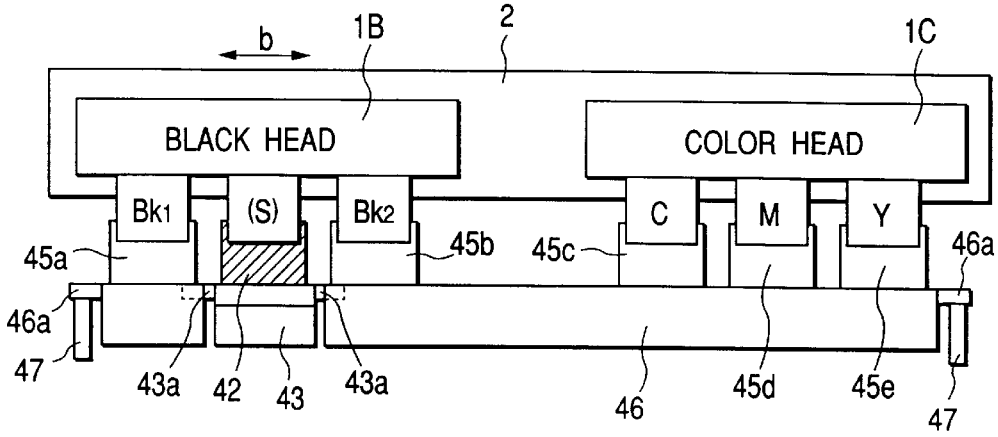
FIG. 18 is a schematic front view of the wiper in FIG. 17 depicted in a direction perpendicular to the main scanning direction of the carriage.

FIG. 17 is a partially exploded, schematic cross-sectional view of a capping unit that caps the head cartridge 1L, which is re-mounted at the same position as that of the head cartridge 1B mounted on the carriage 2 in FIG. 16.

In this case, first, the stopper 210 is rotated, by a mechanism (not shown), from the position shown in FIG. 15 in the direction indicated by an arrow T until its hook 210*b* reaches the position in FIG. 17, and it is then maintained at that position. Then, when the through gear 170 is rotated by a mechanism (not shown) in the direction indicated by the arrow P, the pendulum arm 180 is also rotated in the direction indicated by the arrow P. When the rotation is continued, the shaft 180*a* at the distal end contacts the hook 210*b* of the stopper 210 and further rotation is inhibited. At this time, since the pendulum gear 190 engages the through gear 170, even though the friction portion of the pendulum arm 180 passes over the through gear 170, the rotation is continued. The holder 130, in the state shown in FIG. 16, is rotated by the idle gear 200 in the direction indicated by the arrow V in FIG. 16 until it reaches the state shown in FIG. 17. Since there is no gear on the right side of the right edge teeth 16*a* of the holder 130, at that point the rotation of the holder 130 is halted. The integral cap 120 is rotated in consonance with the rotation of the holder 130, and the protective cap 120*a* is directed toward the discharge face of the head of the head cartridge 1L.

In this condition, the through gear 170 is rotated in the direction indicated by an arrow Q in FIG. 17 to return the pendulum arm 180 and the pendulum gear 190 to the positions shown in FIG. 15, and the stopper 210 is rotated in the direction indicated by an arrow U to return it to the position in FIG. 15.

During the operation, as the holder 120 is rotated in the direction indicated by an arrow S, a projection 120*p* on the holder 120 abuts upon a raised portion 220*b* on the holder 220. When contact is made, the holder 220 is rotated in the direction indicated by an arrow Y. As a result of this rotation, the wiper 42 is folded back, and does not abut upon any head chip. In the situation where the wiper 42 is folded back, the head cartridge 1L can be loaded.

The wiping operation when the individual heads are loaded will now be described.

When the head cartridge lB is loaded into the carriage 1 as is shown in FIG. 16, the wiper 42 is so set that it can contact the head chip S of the head cartridge 1B, as previously mentioned.

The holders 43 and 46 are at standby position A in the previous embodiment. Then, as the carriage 2 is moved in the main scanning direction (as indicated by an arrow b) until it is located at the position shown in FIG. 18, the wiping is performed in the same manner as in the third embodiment. In this embodiment, six head chips are wiped at one time.

Figure 19:
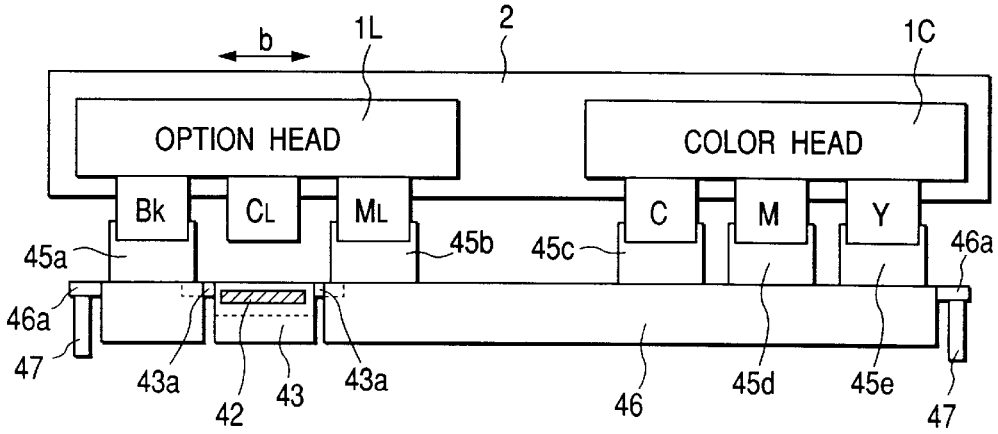
FIG. 19 is a schematic front view of the wiper in FIG. 17 depicted in a direction perpendicular to the main scanning direction of the carriage, and showing the state when a printing enhancement-liquid wiper is folded back.
Figure 20:
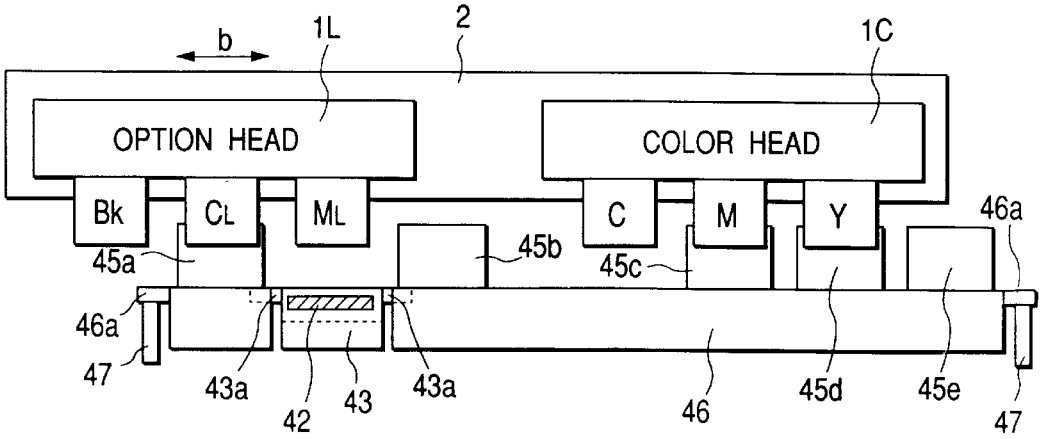
FIG. 20 is a schematic front view of the wiper in FIG. 17 depicted in a direction perpendicular to the main scanning direction of the carriage, and showing the positioning that is performed as the carriage is moved in the main scanning direction.

Next, the wiping operation when the optional head cartridge 1L is loaded into the carriage 2 will now be described. In this case, as is shown in FIGS. 19 and 20, the printing enhancement-liquid wiper 42 is folded back so that it does not contact any head chips. In this situation, the holders 43 and 46 are at standby position A in FIG. 10. Then, as the carriage 2 is moved in the main scanning direction (as indicated by the arrow b) until it is located at the position shown in FIG. 19, the holders 43 and 46 are wiped in the same manner as in the third embodiment. In this case, the wiping is performed for five head chips, excluding the light cyan-ink head chip c, i.e., the black-ink head chip K, the light magenta-ink head chip m, the cyan-ink head chip C, the magenta-ink head chip M and the yellow-ink head chip Y.

Following this, the carriage 2 is retracted in the main scanning direction so that the wipers are not in contact with any head chips. Then, the holders 43 and 46 are moved to standby position A, and the carriage 2 is again moved in the main scanning direction until it is located at the position in FIG. 20. Thereafter, the wiper 45*a* wipes the cyan ink head chip c, which was not wiped during the preceding wiping process, and the wipers 45*c* and 45*d* again wipe the magenta-ink head chip M and the yellow-ink head chip Y.

In this embodiment, in order to prevent any unnecessary contact by a specific wiper, the wipers are folded back and retracted when they are not required. by Two wipers may be arranged in an L shape with the phase being shifted at 90°, i.e., the same structure as the capping unit shown in FIGS. 15 to 17 may be employed. With this arrangement, all the head chips can be wiped at one time, regardless of which head cartridge is loaded.

The rotatable projections 220*a* and 220*b*, which support the wiper 42 in FIGS. 15 to 17, may be extended or retracted as needed. With this arrangement, the extension or retraction of a wiper can be easily selected.

The colorless printing enhancement-liquid for insolubilizing the ink dye can be acquired as follows.

The following elements are mixed and dissolved, and are then filtrated under pressure using a membrane filter (product name: Phloropore Filter, produced by Sumitomo Electric Industries, Ltd.) having a pore size of 0.22 μm. The pH of the liquid mixture is adjusted to 4.8, using NaOH, and as a result, a colorless printing enhancement-liquid A1 can be obtained.

| [Elements of Al] | |
|---|---|
| low molecular cationic compound<br>stearyl trimethyl ammonium salt<br>(product name: Electro-Stripper QE, produced by Kao Corporation), or<br>stearyl trimethyl ammonium chloride<br>(product name: Utamine 86P, produced by Kao Corporation) | 2.0 parts |
| macromolecular cationic compound<br>copolymer of diarylamine hydrochloric acid salt and sulfuric dioxide<br>(mean molecular weight: 5000)<br>(product name: polyamine sulfone PAS-92, produced by Nitto Bosaki Co., Ltd.) | 3.0 parts |
| thiodiglycol | 10 parts |
| water | remainder |

An example preferable ink that is mixed with the above colorless printing enhancement-liquid and is insolubilized is as follows.

The following elements are mixed and filtrated under pressure using a membrane filter (product name: Phloropore Filter, produced by Sumitomo Electric Industries, Ltd.) having the pore size of 0.22 μm. As a result, yellow, magenta, cyan and black inks Y1, M1, C1 and K1 can be acquired.

Y1

| | |
|---|---|
| C.I. direct yellow 142 | 2 parts |
| thiodiglycol | 10 parts |
| product name: Acetylenol EH<br>(produced by Kawaken fine Chemicals Co., Ltd.) | 0.05 parts |
| water | remainder |

M1

Has the same composition as Y1 except that the dye is replaced by 2.5 of C.I. acid red 289.

C1

Has the same composition as Y1 except that the dye is replaced by 2.5 of C.I. acid blue-9.

K1

Has the same composition as Y1 except that the dye is replaced by 3 of C.I. food black 2.

According to the present invention, since the colorless printing enhancement-liquid (liquid compound) and ink are mixed at the surface of a recording medium, or at a location whereat they have penetrated in the surface of the recording medium, at the first reaction stage, an association is produced by the ionic inter-reactions of the low molecular element or the cationic oligomer of the cationic compound, which is contained in the colorless printing enhancement-liquid, and a soluble dye that is used in ink and includes an anion. As a result, a very rapid liquid phase separation occurs.

At the second reaction stage, since the associative element of the dye and the low molecular cationic material, or the cationic oligomer, is absorbed by the macromolecules contained in the colorless printing enhancement-liquid, the size of the cohesive dye particles that are generated as a result of the association is increased and it is difficult for the associative element to enter a gap between the fibers of a recording member. As a result, as only the liquid that is separated penetrates the surface of the recording paper, the desired printing quality can be achieved and the required fixing performed. At the same time, the viscosity of the cohesive material, which is composed of the small molecules of the cationic material or the cationic oligomer, generated using the above described mechanism, and the anion dye, is increased, and the adhesive material can not be conveyed by a liquid medium. Therefore, even when adjacent ink dots are formed with different colored inks, as in full-color image forming, the colors will not mix and bleeding will not occur. The cohesive material is originally insoluble in water, and any image that is formed with it is completely water-resistant. In addition, the shielding effect of a polymer improves the light resistance of an image that is formed.

The terms "insolubilization" and "cohesion" as used in this specification refer only to a phenomenon at the first reaction stage or a phenomenon at both the first and the second reaction stages.

In these embodiments, the cationic macromolecular material having a large molecular weight, or the polyhydric metal salt, both of which are used in the prior art, are not required, or are employed to provide only an auxiliary enhancement of the effect available with the present invention, in order that the amount of the material that is used can be reduced to a minimum. Therefore, another effect provided by the present invention is the elimination of the chromogenic deterioration of dye, which is a conventional problem that occurs when cationic macromolecular material or polyhydric metal salt is employed to obtain a water-resistant product.

The recording media used for the present invention are not particularly limited, and conventional regular paper, such as copy paper and bond paper, can be employed. In addition, coated paper, which is specially produced for ink-jet printing, or OHP transparent film can be employed. Ordinary high quality paper or glossy paper can also be employed.

Ink used for the present invention is not limited to dye ink, and pigment ink, in which a pigment is dispersed, can be used. A cohesive colorless printing enhancement-liquid that can induce the coherence of a pigment can be employed. An example pigment ink that is mixed with the previously described colorless liquid Al that induces coherence is as follows. That is, the following process is performed to obtain yellow, magenta, cyan and black inks Y2, M2, C2 and K2 that contain a pigment and an anion compound.

<Black ink K2>

Anion macromolecule P-1 (styrene-methacrylic acid-ethylacrylate, 400 acid value, 6,000 weight-average molecular weight, water solution of 20% solidity, neutralizer: potassium hydroxide) was employed as a disperser, and the following materials were prepared in a batch-type vertical sandmill (produced by Imex Co., Ltd.) filled with glass beads having a diameter of 1 mm that acted as media. The dispersion process was performed for three hours while cooling the material with water. The viscosity after dispersion was 9 cps, and pH was 10.0. The dispersed liquid was placed in a centrifuge and large particles were removed. As a result, a carbon black dispersed material having a weight-average particle size of 100 nm was fabricated.

| (composition of carbon black dispersed material) | |
|---|---|
| P-1 water solution (20% solidity) | 40 parts |
| carbon black (product name: Mogul L, produced by Cablack Corp.) | 24 parts |
| glycerol | 15 parts |
| ethyleneglycol monobutyl ether | 0.5 parts |
| isopropyl alcohol | 3 parts |
| water | 135 parts |

Then, the above obtained dispersed material was sufficiently diffused, and ink-jet black ink K2 containing a pigment was obtained. The solidity of the final formulation was about 10%.

<Yellow ink Y2>

Anion macromolecule P-2 (styrene-acrylic acid-methylacrymetalate, 280 acid value, 11,000 weight-average molecular weight, water solution of 20% solidity, neutralizer: diethanolamine) was employed as a disperser. The dispersion process was performed by using the following materials in the same manner as for the production of the black ink K2. As a result, a yellow dispersed material having a weight-average particle size of 103 nm was fabricated.

| (composition of yellow dispersed material) | |
|---|---|
| P-2 water solution (20% solidity) | 35 parts |
| C.I. pigment yellow 180 (product name: Novapalm yellow PH-G, produced by Hoechst Aktiengesellschaft Corp.) | 24 parts |
| triethyleneglycol | 10 parts |
| diethyleneglycol | 10 parts |
| ethyleneglycol monobutyl ether | 1.0 parts |
| isopropyl alcohol | 0.5 parts |
| water | 135 parts |

The above obtained yellow dispersed material was sufficiently diffused, and ink-jet yellow ink Y2 containing a pigment was obtained. The solidity of the final formulation was about 10%.

<Cyan ink C2>

Anion macromolecule P-1 used for the production of the black ink K2 was employed as a disperser. The dispersion process was performed by using the following materials in the same manner as for the production of the carbon black dispersed material. As a result, a cyan dispersed material having a weight-average particle size of 120 nm was fabricated.

| (composition of cyan dispersed material) | |
|---|---|
| P-1 water solution (20% solidity) | 30 parts |
| C.I. pigment blue 15:3 (product name: Fastgenble-FGF, produced by Dainippon Ink And Chemicals, Inc.) | 24 parts |
| glycerol | 15 parts |
| diethyleneglycol monobutyl ether | 0.5 parts |
| isopropyl alcohol | 3 parts |
| water | 135 parts |

The above obtained cyan dispersed material was sufficiently diffused, and ink-jet cyan ink C2 containing a pigment was obtained. The solidity of the final formulation was about 9.6%.

<Magenta ink M2>

Anion macromolecule P-1 used for the production of the black ink K2 was employed as a disperser. The dispersion process was performed by using the following materials in the same manner as for the production of the carbon black dispersed material. As a result, a magenta dispersed material having a weight-average particle size of 115 nm was fabricated.

| (composition of magenta dispersed material) | |
|---|---|
| P-1 water solution (20% solidity) | 20 parts |
| C.I. pigment red 122 (produced by Dainippon Ink And Chemicals, Inc.) | 24 parts |
| glycerol | 15 parts |
| isopropyl alcohol | 3 parts |
| water | 135 parts |

The above obtained magenta dispersed material was sufficiently diffused, and ink-jet magenta ink M2 containing a pigment was obtained. The solidity of the final formulation was about 9.2%.

(Others)

The present invention includes means (e.g., electro-thermal converting element or a laser beam) for generating thermal energy to be used for the discharge of ink, and provides superior effects for a recording head or recording apparatus that generates a change in the ink condition due to thermal energy. High density and high precision recording can be performed.

The typical, preferable structure, or the principle, is the one disclosed in, for example, U.S. Pat. No. 4,723,129 and U.S. Pat. No. 4,740,796. This system can be applied for either a so-called on-demand type or a continuous type, but is especially effective for the on-demand type. At least one drive signal, which corresponds to recording data and that provides a drastic temperature rise exceeding nucleate boiling, is transmitted to an electro-thermal converting element that is located adjacent to a sheet and a liquid flow path in which liquid (ink) is retained; thermal energy is generated at the electro-thermal converting element; and film boiling is produced at the face of a recording head on which the head acts, with the result that bubbles in the liquid (ink) can be formed at a one-to-one correspondence with the drive signal. In accordance with the growth or the compression of a bubble, the liquid (ink) is discharged through a discharging port, and at least one ink droplet is formed. When a drive signal has a pulse shape, this is more preferable because the appropriate growth or compression of a bubble can be effected immediately, and discharge of the liquid (ink) having a superior response characteristic can be implemented. The appropriate pulse-shaped drive signal is the one disclosed in U.S. Pat. No. 4,463,359 or U.S. Pat. No. 4,345,262. When the condition described in U.S. Pat. No. 4,313,124, which is associated with the temperature rise ratio at the face on which the heat acts, is employed, superior recording can be performed.

In addition to the structures (linear flow paths or perpendicular flow paths) of recording heads explained in the above patent specifications wherein discharging ports, liquid flow paths and electro-thermal converting elements are arranged, the present invention also includes the structures of recording heads described in U.S. Pat. No. 4,558,333 and U.S. Pat. No. 4,459,600, wherein a heat acting portion is located at a bent area. Furthermore, the present invention can be effectively used for the structure in Japanese Patent Application Laid-Open No. 59-123670, wherein a common slit is used as the discharging ports of a plurality of electro-thermal converting elements, and for the structure in Japanese Patent Application Laid-Open No. 59-138461, wherein an opening for absorbing the pressure wave of thermal energy is formed that corresponds to each discharging port. In other words, according to the present invention, recording can be precisely and efficiently performed, regardless of the form of the recording head.

Further, the present invention can be effectively used for a full-line recording head that has a length corresponding to the maximum width of a recording medium that a recording apparatus can print. The length can be satisfied by an assembly composed of a plurality of recording heads, or by a single, integrally formed recording head.

Moreover, the present invention can be effectively used not only for the above described serial type recording head, but also for a recording head fixed to the apparatus, an exchangeable chip type recording head that is attached to the apparatus to enable the supply of electricity by the apparatus and the supply of ink from the apparatus, or a cartridge type recording head for which an ink tank is an integral part.

It is preferable that the discharge recovery means, extra auxiliary means, etc., be provided as part of the structure of the recording apparatus of the present invention, because better stabilization of the effect of the present invention is possible. Specifically, these means for a recording head include capping means; cleaning means; pressurization or suction means; preliminary heating means for heating using an electro-thermal converting element or another heating element, or a combination of them; and preliminary discharge means for the separate discharge of ink other than that used for recording.

As for the types and the number of recording heads that are mounted, only one recording head may be provided for a single color ink, or a plurality of recording heads may be provided for a plurality of ink types that differ in color and density. That is, the present invention is considerably effective when used for a recording apparatus that not only has a recording mode using a primary color, such as black, but also has either a compound color recording mode using different colors, or a full color recording mode involving the mixing colors, that is provided by an integrally formed recording head or by an assembly composed of a plurality of recording heads.

The ink in the above described embodiments is employed as a liquid. However, ink that is insolubilization at a temperature lower than room temperature and softened or liquefied at room temperature may be employed. Or else, since it is common with the ink-jet recording systems for the temperature of ink to be adjusted within a range from 30° C. to 70° C. to maintain the viscosity of ink within a stable discharge range, ink that is liquefied upon the receipt of a recording signal may be employed. In addition, ink that is insolubilized in the unused state and is liquefied by heating may be used in order to employ the temperature rise as energy for changing the ink from the solid state to the liquid state and to prevent a temperature rise due to the thermal energy, or in order to prevent the evaporation of ink. The present invention can be effectively applied for ink that, for discharge, is liquefied by thermal energy upon the receipt of a recording signal, or ink that begins to insolubilize when it reaches the surface of a recording medium. The ink in this case may be located opposite the electro-thermal converting element while it is retained as a liquid, or a solid, in a recessed portion in a porous sheet or along a through hole, as is described in Japanese Patent Application Laid-Open No. 54-56847 or 60-71260. In the present invention, the apparatus that employs the film boiling method provides the best effect with the above described ink.

In addition, the ink-jet recording apparatus of the present invention may be used as an image output terminal for an information processing apparatus, such as a computer, a copying machine used with a reader, or a facsimile machine having a transmission/reception function.

What is claimed is:

1. A liquid discharge apparatus comprising:

a movable carriage for selectively mounting a recording liquid discharging portion formed with a recording liquid discharging port for discharging a recording liquid, and a processing liquid discharging portion formed with a processing liquid discharging port for discharging a processing liquid to process said recording liquid;

a recording liquid recovery member dedicated for, when said carriage is halted with said recording liquid discharging portion being mounted to the carriage, capping a face in which said recording liquid discharging port is formed; and a processing liquid recovery member dedicated for, when said carriage is halted with said processing liquid discharging portion being mounted to the carriage, capping a face in which said processing liquid discharging port is formed, wherein said recording liquid recovery member and said processing liquid recovery member are integrally provided and are selectively utilized by a rotational movement within a range of 120 degrees or a substantially linear movement in a plane substantially perpendicular to a direction in which said carriage moves.

2. A liquid discharge apparatus according to claim 1, wherein the movement of said processing liquid recovery member in said plane is a rotation of said processing liquid recovery member.

3. A liquid discharge apparatus according to claim 2, wherein an angle of said rotation of said processing liquid recovery member falls within a range of from 60° to 100°.

4. A liquid discharge apparatus according to claim 3, wherein an angle of said rotation of said processing liquid recovery member falls within a range of from 80° to 100°.

5. A liquid discharge apparatus according to claim 4, wherein an angle of said rotation of said processing liquid recovery member is almost 90°.

6. A liquid discharge apparatus according to claim 1, wherein the displacement of said processing liquid recovery member in said plane is a substantially linear displacement of said processing liquid recovery member.

7. A liquid discharge apparatus according to claim 1, wherein said recording liquid recovery member is a recording liquid capping member for capping a face in which said recording liquid discharging port is formed, and said processing liquid recovery member is a processing liquid capping member for capping a face in which said processing liquid discharging port is formed.

8. A liquid discharge apparatus according to claim 7, wherein said processing liquid capping member communicates with a pump for sucking from said processing liquid discharging port.

9. A liquid discharge apparatus according to claim 8, wherein said recording liquid capping member communicates with a pump for sucking from said recording liquid discharging port.

10. A liquid discharge apparatus according to claim 7, wherein said recording liquid capping member does not communicate with a pump for sucking from said recording liquid discharging port, wherein displacing said carriage causes a second recording liquid capping member which differs from said recording liquid capping member and communicates with said pump to face said recording liquid discharging port, so that suction of liquid from said recording liquid discharging port is initiated.

11. A liquid discharge apparatus according to claim 1, wherein said processing liquid insolubilizes a color material contained in said recording liquid with respect to a solvent.

12. A liquid discharge apparatus according to claim 1, wherein said recording liquid discharging portion includes a light-cyan discharging port array from which a light-cyan recording liquid is discharged, and forms a recording head together with a black discharging port array, from which a black recording liquid is discharged, and a light magenta discharging port array, from which a light magenta recording liquid is discharged, said black and light magenta discharging port arrays sandwiching said light cyan discharging port.

13. A liquid discharge apparatus according to claim 1 or 11, wherein said processing liquid discharging portion includes a processing liquid discharging port array from which said processing liquid is discharged, and forms a recording head together with a plurality of black discharging port arrays, from which a black recording liquid is discharged, said black discharging port arrays sandwiching said processing liquid discharging port.

14. A liquid discharge apparatus according to claim 1, wherein said recording liquid discharging portion and said processing liquid discharging portion are exchangeably mounted on said carriage, and wherein a recording head, which includes discharging port arrays from which cyan, magenta and yellow recording liquids are discharged, is mounted adjacent to recording heads including either of said discharging portions.

15. A liquid discharge apparatus according to claim 1, further comprising:

a plurality of liquid discharge heads for recording on a recording medium, wherein one of said liquid discharge heads includes said recording liquid discharging portion, and wherein another one of said liquid discharge heads includes said processing liquid discharging portion;

a plurality of capping means for individually capping discharge faces of said liquid discharge heads; and cap exchange means for selectively exchanging said capping means, at the same capping position defined for said capping means, in consonance with the type of liquid that is discharged from each of said liquid discharge heads.

16. A liquid discharge apparatus according to claim 15, wherein said plurality of liquid discharge heads are mounted on said carriage which can move relative to said recording medium.

17. A liquid discharge apparatus according to claim 16, wherein at least one of said liquid discharge heads is exchangeable for discharging a different liquid from a different liquid discharge head.

18. A liquid discharge apparatus according to claim 17, further comprising means for detecting the type of an exchangeable liquid discharge head, wherein, to exchange a cap, said capping means are operated in consonance with the result of the detection by the detecting means.

19. A liquid discharge apparatus according to claim 17, further comprising means for detecting the type of a liquid discharged from said exchangeable liquid discharge head, wherein, to exchange a cap, said capping means are operated in consonance with the result of the detection by the detecting means.

20. A liquid discharge apparatus according to claim 17, wherein said exchangeable liquid discharge heads that are located at the same position on said carriage include a specific liquid discharge head for discharging a liquid containing color material, and another liquid discharge head for discharging a liquid containing a material that coheres with or insolubilizes said color material in said liquid discharged from said specific liquid discharge head.

21. A liquid discharge apparatus according to claim 16, wherein said cap exchange means exchanges a cap at the same position and in said direction in which said carriage is moved.

22. A liquid discharge apparatus according to claim 21, wherein said cap exchange operation is performed in a pivotal manner or a rotational manner.

23. A liquid discharge apparatus according to claim 22, wherein, by either a pivotal or rotational operation, said cap exchange means exchanges two types of capping means that are used, depending on said liquid type.

24. A liquid discharge apparatus according to claim 15, wherein, in said plurality of liquids, at least two liquids are included that react chemically or physically with each other.

25. A liquid discharge apparatus according to claim 15, wherein said plurality of capping means corresponding to different liquid types is integrally formed.

26. A liquid discharge apparatus according to claim 15, wherein at least one exchangeable capping means communicates with suction means for sucking and removing a liquid from said discharging ports of said liquid discharge heads.

27. A liquid discharge apparatus according to claim 15, wherein a liquid discharged from said liquid discharge head includes a liquid containing low molecular and macromolecular cationic materials, and a liquid containing anion dye.

28. A liquid discharge apparatus according to claim 15, wherein a liquid discharged from said liquid discharge head includes a liquid containing low molecular and macromolecular cationic materials, and a liquid containing at least an anion dye and a pigment.

29. A liquid discharge apparatus according to claim 15, wherein said liquid discharge head includes an electrothermal converting element that generates, in order to discharge said liquid, thermal energy that causes film boiling of said liquid.

30. A liquid discharge apparatus according to claim 1, further comprising:

a plurality of liquid discharge heads for recording on a recording medium, wherein one of said liquid discharge heads includes said recording liquid discharging portion and wherein another of said liquid discharge heads includes said processing liquid discharging portion;

a plurality of wiping means for individually wiping discharge faces of said liquid discharge heads; and wiper exchange means for selectively exchanging said wiping means, at a wiping position defined by said wiping means, in consonance with a type of liquid that is ejected from each of said liquid discharge heads.

31. A liquid discharge apparatus according to claim 30, wherein said plurality of liquid discharge heads are mounted on said carriage which is displaceable relative to said recording medium.

32. A liquid discharge apparatus according to claim 31, wherein at least one of said liquid discharge heads is exchangeable for discharging a different liquid from a different liquid discharge head.

33. A liquid discharge apparatus according to claim 32, further comprising means for detecting the type of an exchangeable liquid discharge head, wherein, to perform wiping the discharge faces of said liquid discharge heads, said wiping means are operated in consonance with the result of the detection by the detecting means.

34. A liquid discharge apparatus according to claim 32, further comprising means for detecting the type of a liquid discharged from said exchangeable liquid discharge head, wherein, to perform wiping the discharge faces of said liquid discharge heads, said wiping means are operated in consonance with the result of the detection by the detecting means.

35. A liquid discharge apparatus according to claim 32, wherein said exchangeable liquid discharge heads that are located at the same position on said carriage include a specific liquid discharge head for discharging a liquid containing color material, and another liquid discharge head for discharging a liquid containing a material that coheres with or insolubilizes said color material in said liquid discharged from said specific liquid discharge head.

36. A liquid discharge apparatus according to claim 31, wherein said wiper exchange means exchanges a cap at the same position and in said direction in which slid carriage moves.

37. A liquid discharge apparatus according to claim 36, wherein said wiper exchange means exchanges said wiping means in a pivotal manner or a rotational manner.

38. A liquid discharge apparatus according to claim 36, wherein said wiper exchange means includes a support member for supporting all of said plurality of wiping means, and exchanges said wiping means by pivoting or rotating said support member.

39. A liquid discharge apparatus according to claim 36, wherein, by either a pivotal or rotational operation, said wiper exchange means is exchanged between two types of wiping means that are used, depending on said liquid type.

40. A liquid discharge apparatus according to claim 30, wherein said plurality of wiping means corresponding to different liquid types is integrally formed.

41. A liquid discharge apparatus according to claim 30, wherein a specific one of said wiping means for wiping a discharge face of a liquid discharge head for discharging a specific liquid is retractable relative to said discharge face.

42. A liquid discharge apparatus according to claim 41, wherein, when said specific wiping means is retracted from said discharge face of said liquid discharge head, a portion of said discharge face from which liquid has not been removed is wiped while the positional relationship between said plurality of liquid discharge heads and said plurality of wiping means is changed.

43. A liquid discharge apparatus according to claim 41, wherein a support member for supporting said specific wiping means is rotatably or pivotally attached to a support member for supporting said other wiping means.

44. A liquid discharge apparatus according to claim 30, wherein, of said plurality of wiping means corresponding to said plurality of liquid discharge heads, some of said wiping means and other of said wiping means independently perform a wiping process for said discharge faces of said liquid discharge heads.

45. A liquid discharge apparatus according to claim 30, further comprising:

a plurality of capping means for individually capping discharge faces of said liquid discharge heads; and cap exchange means for selectively exchanging said capping means by pivoting or rotating in consonance with a type of said liquid that is discharged from each said liquid discharge head, wherein said wiping means, which interacts with the cap exchange means for said capping means and which wipes said discharge faces of said liquid discharge heads, are selectively exchanged.

46. A liquid discharge apparatus according to claim 30, wherein said wiping means are displaced in a direction in which said discharging ports of said liquid discharge head are arranged.

47. A liquid discharge apparatus according to claim 30, wherein said liquid discharge heads are first to third liquid discharge heads, each of which has first to third nozzle groups; wherein black ink is discharged through said first and third nozzle groups of said first liquid discharge head, and a printing enhancement-liquid is discharged through said second nozzle group; wherein cyan, magenta and yellow inks are discharged through said first to said third nozzle groups of said second liquid discharge head; wherein black ink is discharged through either said first or said third nozzle group of said third liquid discharge head, and a second cyan ink and a second magenta ink, the dye densities of which are lower than those discharged from said second liquid discharge head, are discharged through either said first or said third nozzle group and said second nozzle group; and wherein provided are a first mode for forming a color image using said first and said second liquid discharge heads, and a second mode for forming a color image using said third and said second discharge heads.

48. A liquid discharge apparatus according to claim 47, wherein said first and said third liquid discharge heads are exchangeable.

49. A liquid discharge apparatus according to claim 47, wherein said second nozzle group of said first liquid discharge head is located between said first and said third nozzle groups.

50. A liquid discharge apparatus according to claim 30, wherein a liquid discharged from said liquid discharge head includes a liquid containing low molecular and macromolecular cationic materials, and a liquid containing anion dye.

51. A liquid discharge apparatus according to claim 30, wherein a liquid discharged from said liquid discharge head includes a liquid containing low molecular and macromolecular cationic materials, and a liquid containing at least anion dye and a pigment.

52. A liquid discharge apparatus according to claim 30, wherein said liquid discharge head includes a thermal energy generating element that generates, in order to discharge said liquid, thermal energy that causes film boiling in said liquid.

53. A liquid discharge apparatus according to claim 52, wherein said thermal energy generating member is an electro-thermal converting element for generating thermal energy that induces film boiling of said liquid.

54. A liquid discharge apparatus comprising:

a movable carriage for selectively mounting a recording liquid discharging portion formed with a recording liquid discharging port for discharging a recording liquid, and a processing liquid discharging portion formed with a processing liquid discharging port for discharging a processing liquid to process said recording liquid;

a recording liquid wiping member dedicated for, when said carriage is halted with said recording liquid discharging portion being mounted to the carriage, wiping a face in which said recording liquid discharging port is formed; and a processing liquid wiping member dedicated for, when said carriage is halted with said processing liquid discharging portion being mounted to the carriage, wiping a face in which said processing liquid discharging port is formed, wherein a wiping processing is carried out to the face in which said processing liquid discharging port is formed in such a manner that said processing liquid wiping member moves independently from said recording liquid wiping member in a plane substantially perpendicular to a direction in which said carriage moves.

55. A liquid discharge apparatus according to claim 54, wherein, displacing said carriage causes a wiping liquid capping member different from said recording liquid wiping member to perform wiping said recording liquid discharging port.

* * * * *

UNITED STATES PATENT AND TRADEMARK OFFICE

CERTIFICATE OF CORRECTION

PATENT NO. : 6,293,647 B2
DATED : September 25, 2001
INVENTOR(S) : Yasutsugu Saijo It is certified that error appears in the above-identified patent and that said Letters Patent is hereby corrected as shown below:

Column 1,
Line 51, "ink-tank." should read -- ink tank. --.

Column 3,
Line 13, "movably" should read -- movable --.
Line 19, "liquid," should read -- liquid; --.
Line 23, "formed, and" should read -- formed; and --.
Line 27, "formed;" should read -- formed, --.

Column 6,
Line 16, "can" should read -- can be --.

Column 11,
Line 42, "6" should read -- 8 --.

Column 13,
Line 52, "of" (first occurrence) should read -- at --.
Line 54, "in," should read -- 1n --.
Line 58, "in" should read -- 1n --.

Signed and Sealed this

Seventh Day of May, 2002

*Attest:*

*Attesting Officer*

JAMES E. ROGAN
*Director of the United States Patent and Trademark Office*